US005370985A

United States Patent [19]

Ikeda

[11] Patent Number: 5,370,985

[45] Date of Patent: Dec. 6, 1994

[54] SILVER HALIDE PHOTOGRAPHIC LIGHT-SENSITIVE MATERIAL

[75] Inventor: Hideo Ikeda, Minami-ashigara, Japan

[73] Assignee: Fuji Photo Film Co., Ltd., Kanagawa, Japan

[21] Appl. No.: 74,722

[22] Filed: Jun. 10, 1993

Related U.S. Application Data

[63] Continuation of Ser. No. 860,237, Mar. 27, 1992, abandoned, which is a continuation of Ser. No. 508,357, Apr. 9, 1990, abandoned.

[30] Foreign Application Priority Data

Apr. 19, 1989 [JP] Japan ..... 1-99226
Jun. 19, 1989 [JP] Japan ..... 1-156325

[51] Int. Cl.[5] ..... G03C 1/005

[52] U.S. Cl. ..... 430/567; 430/569; 430/577; 430/581; 430/584; 430/611; 430/613

[58] Field of Search ..... 430/569, 567, 611, 613, 430/581, 584, 577

[56] References Cited

U.S. PATENT DOCUMENTS 4,433,048 2/1984 Solberg et al. ..... 430/567
4,806,461 2/1989 Ikeda et al. ..... 430/569
4,839,263 6/1984 Miyoshi et al. ..... 430/611

*Primary Examiner*—Thorl Chea
*Attorney, Agent, or Firm*—Birch, Stewart, Kolasch & Birch

[57] ABSTRACT

A silver halide photographic light-sensitive material includes at least one light-sensitive silver halide emulsion layer on a support. A silver halide emulsion contained in at least one emulsion layer contains grains having an average grain diameter of 0.3 μm or more, an average grain thickness of less than 0.5 μm and an average grain diameter/average grain thickness ratio of 2 or more in a percentage of at least 50% of a total projected area of emulsion grains. The emulsion is chemically sensitized in the presence of at least one compound represented by the following formula (I):

Formula (I)

wherein X represents hydrogen or alkaline metal, and R represents hydrogen, halogen or alkyl having 1 to 5 carbons.

16 Claims, No Drawings

SILVER HALIDE PHOTOGRAPHIC LIGHT-SENSITIVE MATERIAL

This application is a continuation of application Ser. No. 07/860,237 filed on Mar. 27, 1992, now abandoned which is a continuation application of Ser. No. 07/508,357 filed on Apr. 9, 1990, now abandoned.

BACKGROUND OF THE INVENTION

1. Field of the Invention

The present invention relates to a photographic light-sensitive material and, more particularly, to a silver halide photographic light-sensitive material having good image sharpness and storage stability.

2. Description of the Related Art

A tabular grain is one of several types of various known forms of silver halide grains for use in a silver halide photographic light-sensitive material.

Methods of manufacturing and techniques of using tabular silver halide grains are already disclosed in, for example, U.S. Pat. Nos. 4,434,226, 4,439,520, 4,414,310, 4,433,048, 4,414,306 and 4,459,353 and JP-A-59-99433 and JP-A-62-209445 ("JP-A-" means Unexamined Published Japanese Patent Application). Known advantages obtained by the tabular silver halide grains are, for instance, an increase in sensitivity including an increase in color sensitization efficiency obtained by a sensitizing dye, an improvement in sensitivity/graininess relationship, an increase in sharpness obtained by specific optical properties of the tabular grains and an increase in covering power.

It has become apparent, however, that the tabular silver halide grain generally has a problem in which a latent image produced by exposure fades as time passes (to be referred to as "latent image fading" hereinafter).

As a means for preventing latent image fading, methods of adding a sulfur-, oxygen- or nitrogen-containing compound are disclosed in, for example, GB-1,308,777, GB-1,335,923, GB-1,353,527, GB-1,378,354, GB-1,386,630, GB-1,387,654, GB-1,389,089, GB-1,391,672, GB-1,390,237, GB-1,394,371, GB-1,412,294, GB-1,458,197, U.S. Pat. No. 3,881,939, U.S. Pat. No. 4,397,942, JP-A-47-37922, JP-A-49-17,720, JP-A-57-22234, JP-A-57-158840, JP-A-58-90634 and JP-A-58-152235; a method of adding a sulfinic acid derivative is disclosed in JP-A-57-104,927 and JP-A-62-21,145; and a method of adding various compounds is disclosed in RD (Research Disclosure) No. 17,643.

The present inventors have studied various methods on the basis of the above finding. With respect to tabular silver halide grains, however, each of the above methods has a drawback of, for example, increasing fog. Therefore, even if latent image fading is improved by these methods, they are still problematic to be put into practical use because of their side effect, i.e., an increase in fog, and an immediate solution of this problem has been desired. In addition, demand has arisen for an improvement in incubation resistance of a tabular emulsion at a high temperature, which is conventionally not at a sufficient level.

SUMMARY OF THE INVENTION

It is, therefore, an object of the present invention to provide a silver halide photographic light-sensitive material with improved image sharpness and latent image fading property.

It is another object of the present invention to provide a silver halide photographic light-sensitive material with a high incubation resistance.

In order to achieve the above objects of the present invention, there are provided:

(1) a silver halide photographic light-sensitive material comprising at least one light-sensitive silver halide emulsion layer on a support, wherein a silver halide emulsion contained in the at least one emulsion layer contains grains having an average grain diameter of 0.3 μm or more, an average grain thickness of less than 0.5 μm and an average grain diameter/average grain thickness ratio of 2 or more in a percentage of at least 50% of a total projected area of emulsion grains, and the emulsion is chemically sensitized in the presence of at least one compound represented by the following formula (I):

Formula (I)

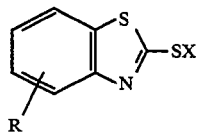

wherein X represents hydrogen or alkaline metal, and R represents hydrogen, halogen or alkyl having 1 to 5 carbons; and (2) a silver halide photographic light-sensitive material according to item (1) above, wherein the emulsion is chemically sensitized further in the presence of a sensitizing dye in an amount of 0.1 milli mol or more per mol of a silver halide.

DETAILED DESCRIPTION OF THE INVENTION

The present invention will be described in detail below.

In the present invention, a tabular silver halide grain (to be referred to as a "tabular grain" hereinafter) means a grain which has two parallel or substantially parallel opposing major surfaces and in which a circle-equivalent diameter (a diameter of a circle having the same projected area as that of the major surface) is twice or more a distance between the two major surfaces.

In an emulsion containing the tabular grains of the present invention, a ratio of an average grain diameter to an average grain thickness (to be referred to as an "average diameter/thickness ratio" hereinafter) is 2 or more, preferably 3 to 12, and more preferably 5 to 10.

Although the average diameter/thickness ratio is obtained by averaging grain diameter/thickness ratios of all tabular grains, it can be obtained more easily as a ratio of an average diameter of all tabular grains to their average thickness.

The average grain diameter (equivalent to a circle of the tabular grains of the present invention is 0.3 μm or more, preferably 0.3 to 10 μm, more preferably 0.5 to 5.0 μm and most preferably 0.5 to 2.0 μm. The average grain thickness of the tabular grains is less than 0.5 μm, preferably 0.05 to 0.4 μm, and more preferably 0.08 to 0.3 μm.

In the present invention, in an emulsion containing the above tabular grains, these tabular grains occupy 50% or more, preferably 70% or more, and more preferably 90% or more of a total projected area of all the grains.

In the present invention, the grain diameter and thickness can be measured by using electron micrographs of grains as described in U.S. Pat. No. 4,434,226.

Examples of a halide composition of the tabular grain which can be used are silver chloroiodide, silver iodobromide, silver chloride, silver chlorobromide, silver bromide and silver chloroiodobromide. The grain may contain, e.g., silver thiocyanate or silver cyanate.

The tabular grains can be formed by arbitrarily combining methods described in, e.g., U.S. Pat. Nos. 4,434,226, 4,439,520, 4,414,310, 4,399,215, 4,433,048, 4,386,156, 4,400,463, 4,414,306 and 4,435,501.

For example, a seed crystal containing 40% (weight) or more of tabular grains is formed in a comparatively high pAg atmosphere having a pBr of 1.3 or less, and silver and halide solutions are added to grow the seed crystal while an identical or higher pBr value is maintained, thereby forming the tabular grains.

The silver and halide solutions are preferably added in such a manner that no new crystal nuclei are produced during a grain growth process due to addition of silver or a halide.

The size of the tabular grains can be adjusted by adjusting the temperature, selecting the type and amount of the solvent and adjusting, e.g., addition rates of a silver salt and a halide for use in grain growth.

Surface of grain of an emulsion containing the tabular grains of the present invention is subjected to chemical sensitization.

The chemical sensitization can be performed by using active gelatin as described in T.H. James, "The Theory of the Photographic Process", 4th ed., Macmillan, 1977, PP. 67 to 76. Alternatively, the chemical sensitization can be performed at a pAg of 5 to 10, a pH of 5 to 8 and a temperature of 30° C. to 80° C. by using sulfur, selenium, tellurium, gold, platinum, palladium, irridium or rhodium, or a combination of a plurality of these sensitizers as described in Research Disclosure Vol. 120, No. 12,008 (April, 1974), Research Disclosure Vol. 34, No. 13,452 (June, 1975), U.S. Pat. Nos. 2,642,361, 3,297,446, 3,772,031, 3,857,711, 3,901,714, 4,266,018, and 3,904,415, and British Patent 1,315,755. The chemical sensitization is optimally performed by using a gold compound and a thiocyanate compound or by using a sulfur-containing compound described in U.S. Pat. Nos. 3,857,711, 4,266,018 and 4,054,457 or a sulfur-containing compound such as a hypo- or thiourea compound and a rhodanine compound. The chemical sensitization can also be performed by using a chemical sensitization aid. An example of the chemical aid is a compound known to suppress fog and increase sensitivity in the chemical sensitization process such as azaindene, azapyridazine, and azapyrimidine. Examples of a chemical sensitization aid are described in U.S. Pat. Nos. 2,131,038, 3,411,914, 3,554,757, JP-A-58-126526 and G. F. Duffin, "Photographic Emulsion Chemistry", PP. 138 to 143. In addition to or in place of the chemical sensitization, reduction sensitization can be performed by using, e.g., hydrogen as described in U.S. Pat. Nos. 3,891,446 and 3,984,249, by using stannous chloride, thiourea dioxide, polyamine and a reducing agent of this type as described in U.S. Pat. Nos. 2,518,698, 2,743,182 and 2,743,183 or by performing a low-pAg (e.g., less than 5) or high-pH (e.g., more than 8) treatment. In addition, chemical sensitization methods described in U.S. Pat. Nos. 3,917,485 and 3,966,476 can be applied.

A sensitizing method using an oxidizing agent described in JP-A-61-3134 or JP-A-61-3136 can also be applied.

At least one type of a compound represented by formula (I) described above is in the presence in an emulsion containing the above tabular grains of the present invention during the chemical sensitization. The compound may be added at any time, e.g., in a normal emulsion preparing process, during grain formation, during subsequent desalting, then after dispersion and immediately before chemical sensitization is performed, or during the chemical sensitization. When the compound is added during grain formation, the addition may be performed after addition of preferably 50%, and more preferably 80% of the total silver nitrate amount is finished.

An addition amount after desalting is preferably $1\times10^{-5}$ mol to $1\times10^{-3}$ mol per mol of the all silver halide in the emulsion. When the compound is added during grain formation, an addition amount of the compound is preferably larger than, e.g., about five times that of the compound added after desalting.

In formula (I), X represents hydrogen or alkaline metal (e.g., lithium, sodium or potassium), preferably hydrogen, Na or K, and more preferably hydrogen or Na.

R represents hydrogen, halogen (e.g., fluorine, chlorine or bromine) or alkyl having 1 to 5 carbons. The alkyl group may have a substituting group. R is preferably hydrogen, fluorine, chlorine or an alkyl group having 1 to 5 carbons. The number of substituting groups represented by R is preferably 1 or 2.

Preferable examples of a compound represented by formula (I) will be listed in Table A to be presented later.

In the present invention, the following monodisperse hexagonal tabular silver halide grains can be used as the tabular grains described above.

This emulsion is a silver halide emulsion comprising a dispersion medium and silver halide grains. In the emulsion, 70% or more of a total projected area of the silver halide grains is occupied by hexagonal tabular silver halide grains in which a ratio of the length of an edge having a maximum length to the length of an edge having a minimum length is 2 or less and which has two parallel surfaces as outer surfaces. A variation coefficient (a value obtained by dividing a variation (standard deviation) in grain sizes represented by a circle-equivalent diameter of a projected area by an average grain size) of a grain size distribution of the hexagonal tabular silver halide grains is 20% or less, i.e., the grains have a monodispersibility an aspect ratio of the grains is 2.5 or more and their grain size is 0.2 μm or more.

A composition of the hexagonal tabular grain may be any of silver bromide, silver iodobromide, silver chlorobromide and silver chloroiodobromide. When the grains contain iodide ions, the content of the ions is 0 to 30 mol %. A crystal structure of the grain may be uniform, may have different halide compositions in its interior portion and surface portion, and may be layered. The grain preferably contains a reduction-sensitized silver nucleus.

The above silver halide grains can be manufactured by nucleation-Ostwald ripening and grain growth. This manufacturing method is described in detail in JP-A-63-151618.

In the manufacture of an emulsion containing the tabular grains of the present invention, a method of increasing addition rates, addition amounts and addition concentrations of a silver salt solution (e.g., an aqueous $AgNO_3$ solution) and a halide solution (e.g., an aqueous KBr solution) added in order to accelerate grain growth is preferably used.

These methods can be referred to in, e.g., British Patent 1,335,925, U.S. Pat. Nos. 3,672,900, 3,650,757 and 4,242,445; JP-A-55-142329 and JP-A-55-158124.

A silver halide solvent can be effectively used to accelerate ripening. For example, a method of adding an excessive amount of halide ions in a reactor vessel in order to accelerate ripening is known. Therefore, ripening can be accelerated by only introducing a halide solution into a reactor vessel. In addition, another ripening agent can be used. A total amount of such a ripening agent or agents can be blended in a dispersion medium in a reactor vessel before silver and a halide are added, or the ripening agent can be introduced in a reactor vessel together with one or more halides, a silver salt or a deflocculant. Alternatively, the ripening agent can be independently introduced in the step when a halide and a silver salt are added.

Examples of the ripening agent other than halide ions are ammonia, an amine compound, a thiocyanate salt such as an alkaline metal thiocyanate especially a sodium thiocyanate salt, a potassium thiocyanate salt and an ammonium thiocyanate salt. The use of a thiocyanate ripening agent is described in U.S. Pat. Nos. 2,222,264, 2,448,534 and 3,320,069. A thioether ripening agent which is normally used as described in U.S. Pat. Nos. 3,271,157, 3,574,628 and 3,737,313 can also be used. In addition, a thione compound as disclosed in JP-A-53-82408 and 53-144319 may be used.

The properties of the silver halide grains can be controlled by adding various types of compounds in a silver halide precipitation process. Such a compound can be added in a reactor vessel from the beginning or added together with one or more salts in accordance with a conventional method. As described in U.S. Pat. Nos. 2,448,060, 2,628,167, 3,737,313 and 3,772,031 and Research Disclosure, Vol. 134, No. 13452, (June 1975), the characteristics of the silver halide can be controlled by virture of the presence of a compound such as a compound of copper, iridium, lead, bismuth, cadmium, zinc, (a compound of chalcogen such as sulfur, selenium and tellurium), gold and noble metal of a Group VIII in the silver halide precipitation process. The interior of the grain of the silver halide emulsion can be reduction-sensitized in the precipitation process as described in JP-B-58-1410 ("JP-B-" means Examined Published Japanese Patent Application) and Moisar et al., "Journal of Photographic Science", Vol. 25, 1977, PP. 19 to 27.

In the tabular grains used in the present invention, a silver halide having a different composition may be junctioned by an epitaxial junction, or a compound other than a silver halide such as silver rhodanate and zinc oxide may be junctioned. These emulsion grains are disclosed in, e.g., U.S. Pat. Nos. 4,094,684, 4,142,900 and 4,459,353, British Patent 2,038,792, U.S. Pat. Nos. 4,349,622, 4,395,478, 4,433,501, 4,463,087, 3,656,962 and 3,852,067 and JP-A-59-162540.

An emulsion containing the tabular grains used in the present invention can be used together with normal chemically-sensitized silver halide grains (to be referred to as "nontabular grains" hereinafter) in the same silver halide emulsion layer. Especially in a color photographic light-sensitive material, a tabular grain-containing emulsion and a nontabular grain-containing emulsion can be used in different emulsion layers and/or the same emulsion layer, and the emulsion containing the tabular grains is preferably contained in an amount of 50 mol % (per mol of silver halide). Examples of the nontabular grain are regular grains having regular crystals such as cubic, octahedral and tetradecahedral crystals and grains having irregular crystals such as spherical and potate-like crystals. A silver halide composition of these grains may be any of silver bromide, silver iodobromide, silver iodochlorobromide, silver chlorobromide and silver chloride. A preferable silver halide is silver iodobromide or silver iodochlorobromide containing 30 mol % or less of silver iodide, and most preferably silver iodobromide containing 2 to 25 mol % of silver iodide.

The nontabular grain used in the present invention may be a fine grain having a grain size of 0.1 μm or less or a large grain having a projected area diameter of up to 10 μm. An emulsion may be a monodisperse emulsion having a narrow distribution or a polydisperse emulsion having a wide distribution.

The nontabular grains for use in the present invention can be prepared by using methods described in, for example, P. Glafkides, "Chimie et Physique Photographique", Paul Montel, 1967; Duffin, "Photographic Emulsion Chemistry", Focal Press, 1966; and V. L. Zelikman et al., "Making and Coating Photographic Emulsion", Focal Press, 1964. That is, the photographic emulsion can be prepared by, for example, an acid method, a neutralization method, and an ammonia method. Also, as a system for reacting a soluble silver salt and a soluble halide, a single mixing method, a double mixing method, or a combination thereof can be used. Also, a so-called back mixing method for forming grains in the presence of excessive silver ions can be used. As one system of the double mixing method, a so-called controlled double jet method wherein the pAg in the liquid phase where the silver halide is produced is kept at a constant value can be used. According to this method, a silver halide emulsion having a regular crystal form and almost uniform grain sizes is obtained.

Two or more types of independently formed silver halide emulsions may be mixed.

The silver halide emulsion containing the above-described regular grains can be obtained by controlling the pAg and pH during grain formation. More specifically, such a method is described in "Photographic Science and Engineering", Vol. 6, PP. 159 to 165 (1962); "Journal of Photographic Science", Vol. 12, PP. 242 to 51 (1964); U.S. Pat. No. 3,655,394; and British Patent 1,413,748.

The monodisperse emulsion is described in, for instance, JP-A-48-8600, JP-A-51-39027, JP-A-51-83097, JP-A-53-137133, JP-A-54-48521, JP-A-54-99419, JP-A-58-37635, JP-A-58-49938, JP-B-47-11386, U.S. Pat. No. 3,655,394 and British Patent 1,413,748.

A crystal structure of these nontabular grains may be uniform, may have different halide compositions in its interior portion and surface portion or may be layered. These emulsion grains are disclosed in British Patent 1,027,146, U.S. Pat. Nos. 3,505,068 and 4,444,877 and Japanese Patent Application No. 58-248469.

In the present invention, an emulsion of a non-light-sensitive fine grain having a grain size of 0.6 μm or less, and preferably 0.2 μm or less may be added to a silver halide emulsion layer, an interlayer or a protective layer in order to, for example, accelerate development, improve storage stability or effectively use reflected light.

The tabular grains of the present invention are preferably used in a color light-sensitive material for photography.

The use of the tabular grains of the present invention and nontabular monodisperse silver halide grains in the same layer and/or different layers is effective to improve sharpness.

In this case, the monodisperse silver halide emulsion (nontabular grains) is defined as an emulsion in which 95% or more of the total weight or total number of silver halide grains contained in the emulsion have grain sizes falling within the range of ±40%, and preferably ±30% of an average grain size. The fact that graininess can be improved by using a monodisperse silver halide emulsion in a silver halide photographic light-sensitive material is described in, for instance, JP-B-47-11386, JP-A-55-142329, JP-A-57-17235 and JP-A-59-72440. As described in T. H. James, "The Theory of Photographic Process" PP 580 to 585 monodisperse silver halide grains having a grain size of 0.3 to 0.8 μm have large light scattering with respect to light having a specific wavelength but have comparatively small light scattering with respect to light having other wavelengths.

Therefore, by properly arranging a tabular silver halide emulsion and a monodisperse silver halide emulsion in consideration of the optical characteristics of both the emulsions, the sharpness of the silver halide photographic light-sensitive material can sometimes be improved.

Several examples of this aspect will be described below.

Example 1) In a light-sensitive material in which red-, green- and blue-sensitive layers are arranged in this order from a support, if an average grain size of silver halide grains contained in a silver halide emulsion layer constituting the blue-sensitive layer falls within the range of 0.3 to 0.8 μm, tabular silver halide grains are used in this emulsion layer. If the average grain size falls outside the above range, a monodisperse silver halide is used. As a result, the sharpness of the green- and red-sensitive layers can be improved.

Example 2) In a light-sensitive material having the same layer arrangement as that of Example 1, if an average grain size of silver halide grains contained in a silver halide emulsion layer constituting a green-sensitive layer falls within the range of 0.4 to 0.8 μm, tabular silver halide grains are used in this emulsion layer. If the average grain size falls outside the above range, a monodisperse emulsion is used. As a result, the sharpness of a red-sensitive layer can be improved.

Example 3) In a light-sensitive material having the same layer arrangement as that of Example 1 in which an emulsion layer sensitive to each color is constituted by two or more layers having different sensitivities, if a blue-sensitive layer with the highest sensitivity contains a monodisperse silver halide (especially a double structure grain is preferable) having a grain size of 1.0 μm or more and blue-sensitive layer with lower sensitivity has large light scattering, the sharpness of green- and red-sensitive layers can be improved by using the tabular grains in the blue-sensitive layer with lower sensitivity.

Example 4) In a light-sensitive material having the same layer arrangement as that of Example 3, if all of a plurality of green-sensitive layers have large light scattering, the tabular grains are used in all the green-sensitive layers. As a result, the sharpness of red-sensitive layers can be improved while the graininess of the green-sensitive layers is improved.

As in Examples 3 and 4, if each blue-, green- and red-sensitive layers each consist of a plurality of emulsion layers, it should be noted that the tabular silver halide grains is used in emulsion layers having large light scattering and a monodisperse emulsion is used in emulsion layers having small light scattering in order to improve the sharpness and graininess. In Example 4, if the tabular grains are used also in the red-sensitive layer, light scattering between the emulsion layers may be increased to degrade the sharpness of the green-sensitive layer formed on the red-sensitive layer. The use of tabular grains in the red-sensitive layer closest to the support is sometimes not preferable.

As described above, the tabular and nontabular grains for use in the present invention are normally subjected to physical ripening, chemical ripening and spectral sensitization. Additives for use in these processes are described in Research Disclosure Nos. 17643 and 18716 and they are summarized in the following table.

In addition, known photographic additives which can be used in the present invention are described in the above two Research Disclosures and they are summarized in the following table.

| Additives | RD No. 17643 | RD No. 18716 |
|---|---|---|
| 1. Chemical sensitizers | page 23 | page 648, right column |
| 2. Sensitivity increasing agents | | page 648, right column |
| 3. Spectral sensitizers, super sensitizers | pages 23–24 | page 648, right column to page 649, right column |
| 4. Brighteners | page 24 | |
| 5. Antifoggants and stabilizers | pages 24–25<br>pages 24–25 | page 649, right column |
| 6. Light absorbent, filter dye, ultraviolet absorbents | pages 25–26 | page 649, right column to page 650, left column |
| 7. Stain preventing agents | page 25, right column | page 650, left to right columns |
| 8. Dye image stabilizer | page 25 | |
| 9. Hardening agents | page 26 | page 651, left column |
| 10. Binder | page 26 | page 651, left |
| 11. Plasticizers, lubricants | page 27 | page 650, right column |
| 12. Coating aids, surface active agents | pages 26–27 | page 650, right column |
| 13. Antistatic agents | page 27 | page 650, right column |

In the present invention, more preferable effects can be obtained by virtue of the pressure of a sensitizing dye as well as a compound represented by formula (I) during chemical sensitization. In this case, the same or another type of a sensitizing dye may be added to perform spectral sensitization. Examples of the sensitizing dye which is present during chemical sensitization are a cyanine dye, merocyanine dye, a complex cyanine dye, complex merocyanine dye, a holopolar cyanine dye, a styryl dye, a hemicyanine dye, an oxonol dye and a hemioxonol dye.

Effective sensitizing dyes for use in the present invention are described in, for instance, U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632 and 2,503,776, JP-A-48-

76525 and Belgian Patent 691,807. An addition amount of the sensitizing dye is 0.1 mmol or more, preferably 0.1 to 4 mmol, and more preferably 0.2 to 1.5 mmol per mol of a silver halide.

In the present invention, it is especially preferable to use the following cyanine dye.

The cyanine dye suitable for use in the present invention is a compound represented by the following formula (II):

Formula (II)

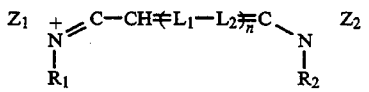

wherein $Z_1$ and $Z_2$ independently represents an atom group required to form a thiazole nucleus, a thiazoline nucleus, a benzthiazole nucleus, a naphthothiazole nucleus, an oxazole nucleus, a benzoxazole nucleus, an oxazoline nucleus, a naphthooxazole nucleus, an imidazole nucleus, a benzimidazole nucleus, an imidazoline nucleus, a selenazole nucleus, a selenazoline nucleus, a benzoselenazole nucleus or naphthoselenazole nucleus.

$R_1$ and $R_2$ independently represents an alkyl group or a substituted alkyl group. Note that at least one of $R_1$ and $R_2$ has a sulfo group or a carboxy group.

$L_1$ and $L_2$ independently represents a substituted or nonsubstituted methine group.

n represents an integer from 0 to 2.

A substituting group may be introduced in a nucleus formed by $Z_1$ or $Z_2$. Examples of the substituting group are alkyl, alkoxy, alkoxycarbonyl, aryl, aralkyl and halogen.

$R_1$ and $R_2$ may be the same or different. An alkyl group of $R_1$ and $R_2$ is preferably an alkyl group having one to eight carbon atoms, e.g., methyl, ethyl, propyl, butyl, pentyl and heptyl. Examples of the substituting group on a substituted alkyl group are carboxy, sulfo, cyano, halogen (e.g., fluorine, chlorine and bromine), hydroxy, alkoxycarbonyl (having eight or less carbon atoms, e.g., methoxycarbonyl, ethoxycarbonyl and benzyloxycarbonyl), alkoxy (having seven or less carbon atoms, e.g., methoxy, ethoxy, propoxy, butoxy and benzyloxy), aryloxy (e.g., phenoxy and p-trlyloxy), acyloxy (having three or less carbon atoms, e.g., acetyloxy and propionyloxy), acyl (having eight or less carbon atoms, e.g., acetyl, propionyl, benzoyl and mecyl), carbamoyl (e.g., carbamoyl, N,N-dimethylcarbamoyl, morpholinocarbamoyl and piperidinocarbamoyl), sulfamoyl (e.g., sulfamoyl, N,N-dimethylsulfamoyl and morpholinosulfonyl), and aryl (e.g., phenyl, p-hydroxyphenyl, p-carboxyphenyl, p-sulfophenyl and α-naphthyl). The number of carbon atoms of the substituted alkyl is preferably six or less.

Examples of the substituted methine group of $L_1$ and $L_2$ are a lower alkyl group (e.g., methyl, ethyl and propyl), phenyl and benzyl.

Examples of the effective sensitizing dye including the above cyanine dye for use in the present invention will be listed in Table B to be presented later.

In this invention, various color couplers can be used in the light-sensitive material. Specific examples of these couplers are described in above-described Research Disclosure, No. 17643, VII-C as patent references.

Preferred examples of a yellow coupler are described in, for example, U.S. Pat. Nos. 3,933,501, 4,022,620, 4,326,024, and 4,401,752, JP-B-58-10739, and British Patents 1,425,020 and 1,476,760.

Examples of a magenta coupler are preferably 5-pyrazolone and pyrazoloazole compounds, and more preferably, compounds described in, for instance, U.S. Pat. Nos. 4,310,619 and 4,351,897, EP 73,636, U.S. Pat. Nos. 3,061,432 and 3,752,067, Research Disclosure No. 24220 (June 1984), JP-A-60-33552, Research Disclosure No. 24230 (June 1984), JP-A-60-43659, and U.S. Pat. Nos. 4,500,630 and 4,540,654.

Examples of a cyan coupler are phenol and naphthol couplers, and preferably, those described in, for example, U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, west German Patent Application (OLS) No. 3,329,729, EP 121,365A, U.S. Pat. Nos. 3,446,622, 4,333,999, 4,451,559, and 4,427,767, and EP 161,626A.

Preferable examples of a colored coupler for correcting additional, undesirable absorption of a colored dye are those described in Research Disclosure No. 17643, VII-G, U.S. Pat. No. 4,163,670, JP-B-57-39413, U.S. Pat. Nos. 4,004,929 and 4,138,258, and British Patent 1,146,368.

Preferable examples of a coupler capable of forming colored dyes having proper diffusibility are those described in U.S. Pat. No. 4,366,237, British Patent 2,125,570, EP 96,570, and West German Patent Application (OLS) No. 3,234,533.

Typical examples of a polymerized dye-forming coupler are described, for example, in U.S. Pat. Nos. 3,451,820, 4,080,211, and 4,367,282, and British Patent 2,102,173.

Couplers releasing a photographically useful residue upon coupling are preferably used in the present invention. Preferable examples of DIR couplers, for instance, couplers releasing a development inhibitor are described in the patents cited in the above-described Research Disclosure No. 17643, VII-F, JP-A-57-151944, JP-A-57-154234, JP-A-60-184248, and U.S. Pat. No. 4,248,962.

Preferable examples of a coupler imagewise releasing a nucleating agent or a development accelerator upon development are those described in British Patents 2,097,140 and 2,131,188, JP-A-59-157638 and JP-A-59-170840.

Examples of a coupler which can be used in the light-sensitive material of the present invention are a competing coupler described in, for example, U.S. Pat. No. 4,130,427; poly-equivalent couplers described in, for example, U.S. Pat. Nos. 4,283,472, 4,338,393 and 4,310,618; DIR redox compound releasing couplers described in, for example, JP-A-60-185950; and a coupler releasing a dye which turns to a colored form after being released as described in EP 173,302A.

The couplers for use in this invention can be introduced in the light-sensitive material by various known dispersion methods.

Examples of a high-boiling solvent used in an oil-in-water dispersion method are described in, for example, U.S. Pat. No. 2,322,027.

Steps and effects of a latex dispersion method and examples of a loadable latex are described in, for instance, U.S. Pat. No. 4,199,363 and West German Patent Application (OLS) Nos. 2,541,274 and 2,541,230.

Examples of a support suitable for use in this invention are described in the above-mentioned RD. No.

17643, page 28 and ibid., No. 18716, page 647, right column to page 648, left column.

A color developer used in developing of the light-sensitive material of the present invention is an aqueous alkaline solution, preferably containing an aromatic primary amine-based color developing agent as a main component. As the color developing agent, although an aminophenol-based compound is effective, a p-phenylenediamine-based compound is preferably used. Typical examples are 3-methyl-4-amino-N,N-diethylaniline, 3-methyl-4-amino-N-ethyl-N-β-hydroxyethylaniline, 3-methyl-4-amino-N-ethyl-N-⊖-methanesulfonamidoethylaniline, 3-methyl-4-amino-N-ethyl-N-β-methoxyehtylaniline, and sulfates, hydrochlorides and p-toluenesulfonates thereof. These compounds can be used in a combination of two or more thereof in accordance with the desired applications.

In general, the color developer contains a pH buffering agent such as a carbonate, a borate or a phosphate of an alkali metal, and a development inhibitor or antifoggant such as a bromide, an iodide, benzimidazoles, benzothiazoles or mercapto compounds. If necessary, the color developer may also contain a preservative such as hydroxylamine, diethylhydroxylamine, hydrazine sulfites, phenylsemicarbazides, triethanolamine, catechol sulfonic acids or a triethylenediamine(1,4-diazabicyclo[2,2,2]octane); an organic solvent such as ethyleneglycol or diethyleneglycol; a development accelerator such as benzylalcohol, polyethyleneglycol, a quaternary ammonium salt or amines; a dye forming coupler; a competing coupler; a fogging agent such as sodium boron hydride; an auxiliary developing agent such as 1-phenyl-3-pyrazolidone; a viscosity imparting agent; and a chelating agent such as an aminopolycarboxylic acid, an aminopolyphosphonic acid, an alkylphosphonic acid or a phosphonocarboxylic acid and salts thereof.

In order to perform reversal development, black-and-white development is performed and then color development is performed. As a black-and-white developer, known black-and-white developing agents, for example, dihydroxybenzenes such as hydroquinone, 3-pyrazolidones such as 1-phenyl-3-pyrazolidone, and aminophenols such as N-methyl-p-aminophenol can be used singly or in a combination of two or more thereof.

The pH of the color and black-and-white developers is generally 9 to 12. Although a replenishment amount of the developer depends on a color photographic light-sensitive material to be processed, it is generally 3 liters or less per $m^2$ of the light-sensitive material. The replenishment amount can be decreased to be 500 ml or less by decreasing a bromide ion concentration in a replenishing solution. In the case of decreasing the replenishment amount, a contact area of a processing tank with air is preferably decreased to prevent evaporation and oxidation of the solution upon contact with air. The replenishment amount can be decreased also by using a means capable of suppressing an accumulation amount of bromide ions in the developer.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the desired applications. Examples of the bleaching agent are a compound of a multivalent metal such as iron (III), cobalt (III), chromium (VI) and copper (II); peroxides; quinones; and nitro compounds. Typical examples of the bleaching agent are a ferricyanide; a dichromate; an organic complex salt of iron (III) or cobalt (III), e.g., a complex salt of an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid, or a complex salt of citric acid, tartaric acid or malic acid; a persulfate; a bromate; a permanganate; and a nitrobenzene.

A bleaching accelerator can be used in the bleaching solution, the bleach-fixing solution and their pre-bath, if necessary.

Examples of the fixing agent are a thiosulfate, a thiocyanate, a thioether-based compound, a thiourea and a large amount of an iodide. Of these compounds, a thiosulfate, especially, ammonium thiosulfate can be used in a widest range of applications. As a preservative of the bleach-fixing solution, a sulfite, a bisulfite or a carbonyl bisulfite adduct is preferred.

The photographic light-sensitive material of the present invention is normally subjected to washing and/or stabilizing steps after desilvering. An amount of water used in the washing step can be arbitrarily determined over a broad range in accordance with the properties (e.g., a property determined by use of a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineers", Vol. 64, PP. 248–253 (May, 1955).

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing solution in place of above described washing. All known methods described in JP-A-57-8543, JP-A-58-14834, and JP-A-60-220345 can be used in such stabilizing processing.

Stabilizing is sometimes performed subsequently to washing. An example is a stabilizing bath containing formalin and a surface-active agent to be used as a final bath of the photographic color light-sensitive material. Various chelating agents or antifungal agents can be added also in the stabilizing bath.

An overflow solution produced upon washing and/or replenishment of the stabilizing solution can be reused in another step such as a desilvering step.

In the present invention, known various types of developing agents can be used to develop a black/white light-sensitive material. Examples are polyhydroxybenzenes such as hydroquinone, 2-chlorohydroquinone, 2-methylhydroquinone, catechol and pyrogallol; aminophenols such as p-aminphenol, N-methyl-p-aminophenol and 2,4-diaminophenol; 3-pyrazolidones such as 1-phenyl-3-pyrazolidone, 1-phenyl-4,4'-dimethyl-3-pyrazolidone, 1-phenyl-4-methyl4-hydroxymethyl-3-pyrazolidone and 5,5-dimethyl-1-phenyl-3-pyrazolidone; and ascorbic acids. These compounds can be used singly or in a combination of two or more thereof. In addition, a developing solution described in JP-A-58-55928 can be used.

A developing agent, a preservative and a buffering agent, a detailed developing method and a method of using the same for a black/white light-sensitive material are described in, e.g., Research Disclosure No. 17643 (December, 1978), XIX–XXI.

EXAMPLES

The present invention will be described in more detail below by way of its examples.

EXAMPLE 1

(1) Preparation of Emulsion

A potate-like silver iodobromide emulsion (AgI=2 mol %) having an average grain size of 0.8 μm was prepared from silver nitrate, potassium bromide and potassium iodide by a normal ammonia method, and the emulsion was desalted by a normal flocculation method, and gold-plus-sulfur sensitization was optimally performed by using chloroauric acid and a compound (A) listed in Table C, thereby preparing an emulsion 1 as a comparative example.

An aqueous solution was obtained by dissolving 6 g of potassium bromide and 30 g of inert gelatin in 3.7 l of distilled water, and a 14% aqueous potassium bromide solution and a 20% aqueous silver nitrate solution were added to the above aqueous solution under stirring at constant flow rates, a temperature of 55° C. and a pBr of 1.0 over one minute by a double jet method (in this addition (I), 2.40% of a total silver amount was consumed). An aqueous gelatin solution (17%, 300 cc) was added and the resultant solution mixture was stirred at 55° C., and a 20% aqueous silver nitrate solution was added at a constant flow rate until the pBr reached 1.40 (in this addition (II), 5.0% of the total silver amount was consumed). A 20% aqueous potassium bromide solution and a 33% aqueous silver nitrate solution were added to the resultant solution mixture over 42 minutes and 51 seconds by the double jet method (in this addition (III), 49.6% of the total silver amount was consumed). During this addition, the temperature and the pBr were maintained at 55° C. and 1.50, respectively. A solution containing 8.3 g of potassium iodide was added (addition IV). A 20% potassium bromide solution and a 33% aqueous silver nitrate solution were added by the double jet method over 37 minutes and 9 seconds (in this addition (V), 43% of the total silver amount was consumed). During the addition, the temperature and the pBr were maintained at 55° C. and 1.50, respectively. The silver nitrate amount used in this emulsion was 425 g. The resultant mixture was desalted by a normal flocculation method and optically, chemically sensitized by using chloroauric acid and the compound (A), thereby preparing a tabular AgBrI (AgI=2.0 mol %) emulsion 2 having an average grain size/grain thickness ratio of 6.5 and a sphere-equivalent diameter of 0.8 μm.

Emulsions 3 to 18 were prepared following the same procedures as for the emulsion 2 except that the compound of the present invention and compounds (B) to (D) as comparative examples were added at various times as listed in Table 1 in place of the compound (A). Formulas of the compounds used in this preparation are listed in Table C.

Note that the chemical sensitization was optimized by adjusting the amounts of chloroauric acid and the compound (A) and the ripening temperature and time upon ripening.

TABLE 1

| Emulsion Name | Addition Compound | Addition Time | Addition Amount mol/total AgX 1 mol |
|---|---|---|---|
| Emulsion-3 | Exemplified Compound-1 | When 85% Of Total Silver Nitrate Was Added During Grain Formation | $5 \times 10^{-6}$ |
| Emulsion-4 | Exemplified Compound-1 | When 85% Of Total Silver Nitrate Was Added During Grain Formation | $5 \times 10^{-5}$ |
| Emulsion-5 | Exemplified Compound-1 | When 85% Of Total Silver Nitrate Was Added During Grain Formation | $5 \times 10^{-4}$ |
| Emulsion-6 | Exemplified Compound-1 | When 85% Of Total Silver Nitrate Was Added During Grain Formation | $5 \times 10^{-3}$ |
| Emulsion-7 | Comparative Compound-(B) | When 85% Of Total Silver Nitrate Was Added During Grain Formation | $5 \times 10^{-5}$ |
| Emulsion-8 | Comparative Compound-(B) | When 85% Of Total Silver Nitrate Was Added During Grain Formation | $5 \times 10^{-4}$ |
| Emulsion-9 | Comparative Compound-(C) | When 85% Of Total Silver Nitrate Was Added During Grain Formation | $5 \times 10^{-5}$ |
| Emulsion-10 | Comparative Compound-(C) | When 85% Of Total Silver Nitrate Was Added During Grain Formation | $5 \times 10^{-4}$ |
| Emulsion-11 | Comparative Compound-(D) | When 85% Of Total Silver Nitrate Was Added During Grain Formation | $5 \times 10^{-5}$ |
| Emulsion-12 | Comparative Compound-(D) | When 85% Of Total Silver Nitrate Was Added During Grain Formation | $5 \times 10^{-4}$ |
| Emulsion-13 | Exemplified Compound-3 | When 85% Of Total Silver Nitrate Was Added During Grain Formation | $5 \times 10^{-4}$ |
| Emulsion-14 | Exemplified Compound-6 | When 85% Of Total Silver | $5 \times 10^{-4}$ |

TABLE 1-continued

| Emulsion Name | Addition Compound | Addition Time | Addition Amount mol/total AgX 1 mol |
|---|---|---|---|
| | | Nitrate Was Added During Grain Formation | |
| Emulsion-15 | Exemplified Compound-8 | When 85% Of Total Silver Nitrate Was Added During Grain Formation | $5 \times 10^{-4}$ |
| Emulsion-16 | Exemplified Compound-1 | Immediately Before Chemical Sensitization | $5 \times 10^{-5}$ |
| Emulsion-17 | Exemplified Compound-1 | Immediately After Chemical Sensitization | $5 \times 10^{-5}$ |
| Emulsion-18 | Exemplified Compound-1 | Immediately After Chemical Sensitization | $5 \times 10^{-4}$ |

(2) Preparation of Coating Sample

A sensitizing dye S-5 was added to each of the emulsions prepared in item (1) above, and dodecylbenzenesulfonate as a coating aid, p-vinylbenzenesulfonate as a thickening agent, a vinylsulfone-based compound as a film hardener and a polyethyleneoxide-based compound as a photographic property improving agent were added to the resultant mixture, thereby preparing an emulsion coating solution. Subsequently, the prepared coating solutions were independently, uniformly coated on undercoated polyester bases, and a surface protective layer mainly consisting of an aqueous gelatin solution was coated thereon, thereby preparing coating samples 1 to 18 having the emulsions 1 to 18, respectively. In each of the samples 1 to 18, a coating silver amount was 4.0 g/m$^2$, a gelatin coating amount of the protective layer was 1.3 g/m$^2$ and a gelatin coating amount of the emulsion layer was 2.7 g/m$^2$.

(3) Evaluation of Coating Sample

Sample pieces of the coating samples 1 to 18 prepared as described above were wedge-exposed for an exposure time of 1/100 sec with an exposure amount of 50 CMS and simultaneously developed by using a developer I having the following composition at 20° C. for 4'. After the developed samples were fixed, washed and dried, sensitometry was performed to obtain photographic sensitivities on the basis of a reciprocal of an exposure amount required for density of fog+0.1.

| Developer I | |
|---|---|
| 1-phenyl-3-pyrazolidone | 0.5 g |
| Hydroquinone | 10 g |
| Disodium Ethylenediaminetetraacetate | 2 g |
| Potassium Sulfite | 60 g |
| Boric Acid | 4 g |
| Potassium Carbonate | 20 g |
| Potassium Thiocyanate | 1.2 g |
| Sodium Bromide | 5 g |
| Diethylene Glycol | 20 g |
| Sodium Hydroxide to obtain a pH of | 10.0 |
| Water to make | 1 l |

Three sample pieces were prepared from each of the coating samples 1 to 18 and wedge-exposed for 1/100". Thereafter, one sample piece was stored at 50° C. and 30% RH for three days, another sample piece was stored at 50° C. and 80% RH for three days, and the remaining sample piece was stored in a freezer to be used as a control. These samples pieces were developed as described above to evaluate latent image storage stability.

The results are summarized in Table 2.

TABLE 2

| Coating Sample No. | Emulsion Name | *) Sensitivity | Latent Image Storage Stability**) (%) 50° C., 30% RH 3 days | 50° C., 80% RH 3 days | Remarks |
|---|---|---|---|---|---|
| 1 | Emulsion-1 | 92 | 90 | 90 | Comparative Example |
| 2 | Emulsion-2 | 100 | 70 | 55 | Comparative Example |
| 3 | Emulsion-3 | 100 | 75 | 55 | Present Invention |
| 4 | Emulsion-4 | 98 | 95 | 90 | Present Invention |
| 5 | Emulsion-5 | 92 | 98 | 92 | Present Invention |
| 6 | Emulsion-6 | 10 | 105 | 98 | Comparative Example |
| 7 | Emulsion-7 | 80 | 80 | 60 | Comparative Example |
| 8 | Emulsion-8 | 5 | 120 | 90 | Comparative Example |
| 9 | Emulsion-9 | 85 | 85 | 70 | Comparative Example |
| 10 | Emulsion-10 | 70 | 95 | 80 | Comparative Example |
| 11 | Emulsion-11 | 90 | 70 | 60 | Comparative Example |
| 12 | Emulsion-12 | 80 | 80 | 70 | Comparative Example |
| 13 | Emulsion-13 | 90 | 95 | 95 | Present Invention |
| 14 | Emulsion-14 | 92 | 95 | 90 | Present Invention |
| 15 | Emulsion-15 | 90 | 98 | 92 | Present Invention |
| 16 | Emulsion-16 | 92 | 98 | 92 | Present Invention |
| 17 | Emulsion-17 | 80 | 85 | 65 | Comparative Example |
| 18 | Emulsion-18 | 10 | 70 | 50 | Comparative Example |

*) The sensitivity is represented as relative sensitivity assuming that sensitivity of the fresh sample 2 is 100.

**) The latent image storage stability is represented by a relative value of sensitivity assuming that the sensitivity of a control of each sample is 100.

As is apparent from Table 2, each emulsion of the present invention has comparatively high sensitivity and good latent image storage stability due to the significant effects of the present invention.

EXAMPLE 2

A plurality of layers having the following compositions were formed on an undercoated triacetylcellulose film support to prepare multilayer color light-sensitive materials in which samples 101 to 106 contain the emulsions 1, 2, 4, 5, 14 and 16 described in Example 1 in their third blue-sensitive layers.

| | |
|---|---|
| Layer 1: Antihalation Layer: | |
| Black Colloidal Silver | 0.25 g/m$^2$ |
| Ultraviolet Absorbent U-1 | 0.1 g/m$^2$ |
| Ultraviolet Absorbent U-2 | 0.1 g/m$^2$ |
| High Boiling Point Organic Solvent Oil-1 | 0.1 g/m$^2$ |
| Gelatin | 1.9 g/m$^2$ |
| Layer 2: Interlayer 1: | |
| Cpd D | 10 mg/m$^2$ |
| Polymethyl Methacrylate Grains (average grain size = 1.5 μm) | 0.1 g/m$^2$ |
| 4:6 Copolymer of Methyl Methacrylate and Acrylic Acid (average grain size = 1.5 μm) | 0.1 g/m$^2$ |
| Silicone Oil | 0.03 g/m$^2$ |
| Fluorine-Containing Surfactant W-1 | 3 mg/m$^2$ |
| Gelatin | 0.8 g/m$^2$ |

Gelatin hardener H-1 and a surfactant were added to the layers in addition to the above compositions. Formulas or names of the compounds used in this example are listed in Table D.

Sample pieces of the samples 101 to 106 obtained as described above were subjected to exposure for sensitivity measurement, exposure for latent image storage stability and incubation by the method described in item (3) of Example 1, and the following development was performed. In addition, the sample pieces of the samples 101 to 106 were exposed by using an MTF measuring wedge to perform the following development.

| Step | Time | Temperature |
|---|---|---|
| 1st Development | 6 min. | 38° C. |
| Washing | 2 min. | 38° C. |
| Reversal | 2 min. | 38° C. |
| Color Development | 6 min. | 38° C. |
| Conditioning | 2 min. | 38° C. |
| Bleaching | 6 min. | 38° C. |
| Fixing | 4 min. | 38° C. |
| Washing | 4 min. | 38° C. |
| Stabilizing | 1 min. | Room Temperature |
| Drying | | |

The compositions of processing solutions were as follows.

| | |
|---|---|
| 1st Developer: | |
| Water | 700 ml |
| Pentasodium Nitrilo-N,N,N-trimethylenephosphonate | 2 g |
| Sodium Sulfite | 20 g |
| Hydroquinone Monosulfonate | 30 g |
| Sodium Carbonate (Monohydrate) | 30 g |
| 1-phenyl-4-methyl-4-hydroxymethyl-3-pyrazolidone | 2 g |
| Potassium Bromide | 2.5 g |
| Potassium thiocyanate | 1.2 g |
| Potassium Iodide (0.1% solution) | 2 ml |
| Water to make | 1,000 ml |
| Reversal Solution: | |
| Water | 700 ml |
| Pentasodium Nitrilo-N,N,N-trimethylenephosphonate | 3 g |
| Stannous Chloride (Dihydrate) | 1 g |
| p-aminophenol | 0.1 g |
| Sodium Hydroxide | 8 g |
| Glacial Acetic Acid | 15 ml |
| Water to make | 1,000 ml |
| Color Developer: | |
| Water | 700 ml |

-continued

| | |
|---|---|
| Pentasodium Nitrilo-N,N,N-trimethylenephosphonate | 3 g |
| Sodium Sulfite | 7 g |
| Tribasic Sodium Phosphate (Dodecahydrate) | 36 g |
| Potassium Bromide | 1 g |
| Potassium Iodide (0.1% solution) | 90 ml |
| Sodium Hydroxide | 3 g |
| Citrazinic Acid | 1.5 g |
| N-ethyl-N-(β-methyanesulfonamidoethyl)-3-methyl-4-aminoaniline Sulfate | 11 g |
| 3,6-dithiaoctane-1,8-diol | 1 g |
| Water to make | 1,000 ml |
| Conditioning Solution: | |
| Water | 700 ml |
| Sodium Sulfite | 12 g |
| Sodium Ethylenediaminetetraacetate (Dihydrate) | 8 g |
| Thioglycerin | 0.4 ml |
| Glacial Acetic Acid | 3 ml |
| Water to make | 1,000 ml |
| Bleaching Solution: | |
| Water | 800 ml |
| Sodium Ethylenediaminetetraacetate (Dihydrate) | 2 g |
| Ammonium Iron (III) Ethylenediaminetetraacetate (Dihydrate) | 120 g |
| Potassium Bromide | 100 g |
| Water to make | 1,000 ml |
| Fixing Solution: | |
| Water | 800 ml |
| Sodium Thiosulfate | 80.0 g |
| Sodium Sulfite | 5.0 g |
| Sodium Bisulfite | 5.0 g |
| Water to make | 1,000 ml |
| Stabilizing Solution: | |
| Water | 800 ml |
| Formaline (37 wt %) | 5.0 ml |
| Fuji Dry-Well (surfactant available from Fuji Photo Film Co., Ltd.) | 5.0 ml |
| Water to make | 1,000 ml |

The color reversal sensitivity of the 3rd blue-sensitive layer was estimated on the basis of a relative exposure amount required for the yellow density larger by 2.0 than a minimum density of the yellow density.

As a result, although the sensitivities of the samples were substantially the same, the latent image storage stability of the sample 102 was significantly poor. When the red- and green-sensitive layers were subjected to MTF measurement to evaluate their sharpness, the sharpness of the sample 101 was significantly poor. That is, it is found that the samples 103 to 106 containing the emulsions of the present invention have good image sharpness and latent image storage stability.

EXAMPLE 3

A plurality of layers having the following compositions were coated on an undercoated triacetylcellulose film support to prepare a sample 201 as a multilayer color light-sensitive material.

(Light-Sensitive Layer Composition)

Numerals corresponding to the respective components indicate coating amounts in units of g/m$^2$. The amount of the silver halide is represented in a silver-converted coated amount. A coating amount of the sensitizing dye is represented in units of mols per mol of the silver halide in the same layer.

(Sample 201)

| | |
|---|---|
| Layer 1: Antihalation Layer | |
| Black Colloid Silver | silver 0.18 |
| Gelatin | 1.40 |
| Layer 2: Interlayer | |
| 2,5-di-t-pentadecylhydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.04 |
| Layer 3: 1st Red-Sensitive Emulsion Layer | |
| Emulsion A | silver 0.25 |
| Emulsion B | silver 0.25 |
| Sensitizing Dye I | $6.9 \times 10^{-5}$ |
| Sensitizing Dye II | $1.8 \times 10^{-5}$ |
| Sensitizing Dye III | $3.1 \times 10^{-4}$ |
| EX-2 | 0.335 |
| EX-10 | 0.020 |
| HBS-1 | 0.060 |
| Gelatin | 0.87 |
| Layer 4: 2nd Red-Sensitive Emulsion Layer | |
| Emulsion G | silver 1.0 |
| Sensitizing Dye I | $5.1 \times 10^{-5}$ |
| Sensitizing Dye II | $1.4 \times 10^{-5}$ |
| Sensitizing Dye III | $2.3 \times 10^{-4}$ |
| EX-2 | 0.400 |
| EX-3 | 0.050 |
| EX-10 | 0.015 |
| HBS-1 | 0.060 |
| Gelatin | 1.30 |
| Layer 5: 3rd Red-Sensitive Emulsion Layer | |
| Emulsion D | silver 1.60 |
| Sensitizing Dye I | $5.4 \times 10^{-5}$ |
| Sensitizing Dye II | $1.4 \times 10^{-5}$ |
| Sensitizing Dye III | $2.4 \times 10^{-4}$ |
| Ex-3 | 0.010 |
| EX-4 | 0.080 |
| EX-2 | 0.097 |
| HBS-1 | 0.22 |
| HBS-2 | 0.10 |
| Gelatin | 1.63 |
| Layer 6: Interlayer | |
| EX-5 | 0.040 |
| HBS-1 | 0.020 |
| Gelatin | 0.80 |
| Layer 7: 1st Green-Sensitive Emulsion Layer | |
| Emulsion A | silver 0.15 |
| Emulsion B | silver 0.15 |
| Sensitizing Dye V | $3.0 \times 10^{-5}$ |
| Sensitizing Dye VI | $1.0 \times 10^{-4}$ |
| Sensitizing Dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-3 | 0.010 |
| Gelatin | 0.63 |
| Layer 8: 2nd Green-Sensitive Emulsion Layer | |
| Emulsion C | silver 0.45 |
| Sensitizing Dye V | $2.1 \times 10^{-5}$ |

-continued (Sample 201)

| | |
|---|---|
| Sensitizing Dye VI | $7.0 \times 10^{-5}$ |
| Sensitizing Dye VII | $2.6 \times 10^{-4}$ |
| EX-6 | 0.094 |
| EX-8 | 0.018 |
| EX-7 | 0.026 |
| HBS-1 | 0.160 |
| HBS-3 | 0.008 |
| Gelatin | 0.50 |
| Layer 9: 3rd Green-Sensitive Emulsion Layer | |
| Emulsion E | silver 1.2 |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| EX-13 | 0.015 |
| EX-11 | 0.100 |
| EX-1 | 0.025 |
| HBS-1 | 0.25 |
| HBS-2 | 0.10 |
| Gelatin | 1.54 |
| Layer 10: Yellow Filter Layer | |
| Yellow Colloid Silver | silver 0.05 |
| EX-5 | 0.08 |
| HBS-1 | 0.03 |
| Gelatin | 0.95 |
| Layer 11: 1st Blue-Sensitive Emulsion Layer | |
| Emulsion A | silver 0.08 |
| Emulsion B | silver 0.07 |
| Emulsion F | silver 0.07 |
| Sensitizing Dye VIII | $3.5 \times 10^{-4}$ |
| EX-9 | 0.721 |
| EX-8 | 0.042 |
| HBS-1 | 0.28 |
| Gelatin | 1.10 |
| Layer 12: 2nd Blue-Sensitive Emulsion Layer | |
| Emulsion G | silver 0.45 |
| Sensitizing Dye VIII | $2.1 \times 10^{-4}$ |
| EX-9 | 0.154 |
| EX-10 | 0.007 |
| HBS-1 | 0.05 |
| Gelatin | 0.78 |
| Layer 13: 3rd Blue-Sensitive Emulsion Layer | |
| Emulsion H | silver 0.77 |
| Sensitizing Dye VIII | $2.2 \times 10^{-4}$ |
| EX-9 | 0.20 |
| HBS-1 | 0.07 |
| Gelatin | 0.69 |
| Layer 14: 1st Protective Layer | |
| Emulsion I | silver 0.5 |
| U-4 | 0.11 |
| U-5 | 0.17 |
| HBS-1 | 0.05 |
| Gelatin | 1.00 |
| Layer 15: 2nd Protective Layer | |
| Polymethylacrylate Grains (diameter = about 1.5 μm) | 0.54 |
| S-1 | 0.20 |
| Gelatin | 1.20 |

In addition to the above components, a gelatin hardener H-1 and a surfactant were added to each layer.

The emulsions A to I used in this example are listed in the following table, and formulas or names of the compounds used in the sample are listed in Table E to be presented later.

| | Average AgI Content (%) | Average Grain Size (μm) | Variation Coefficient According To Grain Size (%) | Diameter/ Thickness | Silver Amount Ratio and AgI Content Ratio (In Parentheses) |
|---|---|---|---|---|---|
| Emulsion A | 4.1 | 0.45 | 27 | 1 | Core/Shell = 1/3 (13/1), Double Structure Grain |

-continued

| | Average AgI Content (%) | Average Grain Size (μm) | Variation Coefficient According To Grain Size (%) | Diameter/ Thickness | Silver Amount Ratio and AgI Content Ratio (In Parentheses) |
|---|---|---|---|---|---|
| Emulsion B | 8.9 | 0.70 | 14 | 1 | Core/Shell = 3/7 (25/2), Double Structure Grain |
| Emulsion C | 10 | 0.75 | 30 | 2 | Core/Shell = 1/2 (24/3), Double Structure Grain |
| Emulsion D | 16 | 1.05 | 35 | 2 | Core/Shell = 1/2 (40/0), Double Structure Grain |
| Emulsion E | 10 | 1.05 | 35 | 3 | Core/Shell = 1/2 (24/3), Double Structure Grain |
| Emulsion F | 4.1 | 0.25 | 28 | 1 | Core/Shell = 1/3 (13/1), Double Structure Grain |
| Emulsion G | 13.6 | 0.75 | 25 | 2 | Core/Shell = 1/2 (40/0), Double Structure Grain |
| Emulsion H | 14 | 1.30 | 25 | 3 | Core Shell = 37/63 (34/3), Double Structure Grain |
| Emulsion I | 1 | 0.07 | 15 | 1 | Uniform Grain |

Samples 202 to 208 were prepared following the same procedures as for the sample 201 except that the emulsion G in the 2nd blue-sensitive layer was replaced by the emulsions 2, 5, 8, 10, 12, 13 and 15 described in Example 1. Sample pieces of the obtained samples 201 to 208 were subjected to exposure for sensitivity measurement, exposure for latent image storage stability evaluation and incubation by the method described in item (3) of Example 1, and the following development was performed by using an automatic developing machine. In addition, the sample pieces of the samples 201 to 208 were exposed by using an MTF measuring wedge and processed by the following processing steps and processing solutions.

| Step | Process Temperature | Time | Replenishment Amount* | Tank Volume |
|---|---|---|---|---|
| | Process Steps | | | |
| Color Development | 37.8° C. | 3'15" | 21 | 5 l |
| Bleaching | 38.0° C. | 45" | 45 | 2 l |
| Fixing (1) | 38.0° C | 45" | (2-Tank Counter Current Scheme) | 2 l |
| Fixing (2) | 38.0° C. | 45" | 30 | 2 l |
| Stabilizing (1) | 38.0° C. | 20" | (3-Tank Counter Current Scheme) | 1 l |
| Stabilizing (2) | 38.0° C. | 20" | | 1 l |
| Stabilizing (3) | 38.0° C. | 20" | 35 | 1 l |
| Drying | 55° C. | 1'00" | | |

*Replenishment Amount: per meter of 35-mm wide light-sensitive material

[Note that a jet stirring apparatus described in JP-A-62-183460, page 3 was mounted in a fixing tank of the automatic developing machine to perform processing by colliding the jet of the fixing solution against the emulsion surface of the light-sensitive material.[

Color Developing Solution:

| | Mother Solution (g) | Replenishment Solution (g) |
|---|---|---|
| Hydroxyethylimino Diacetic acid | 5.0 | 6.0 |
| Sodium Sulfite | 4.0 | 5.0 |
| Potassium Carbonate | 30.0 | 37.0 |
| Potassium Bromide | 1.3 | 0.5 |
| Potassium Iodide | 1.2 mg | — |
| Hydroxylamine Sulfate | 2.0 | 3.6 |
| 4-(N-ethyl-N-β-hydroxylethylamino)-2-methylalinine Sulfate | $1.0 \times 10^{-2}$ mol | $1.3 \times 10^{-2}$ mol |
| Water to make | 1.0 l | 1.0 l |
| pH | 10.00 | 10.15 |

Bleaching Solution:

| | Mother Solution (g) | Replenishment Solution (g) |
|---|---|---|
| Ferric 1,3-diaminopropane Tetraacetate Complex Salt | 130 | 190 |
| 1,3-diaminopropane-tetraacetic acid | 3.0 | 4.0 |
| Ammonium Bromide | 85 | 120 |
| Acetic Acid | 50 | 70 |
| Ammonium Nitrate | 30 | 40 |
| Water to make | 1.0 l | 1.0 l |
| Acetic acid and ammonia to adjust pH | pH 4.3 | pH 3.5 |

Fixing Solution:

| | Mother Solution (g) | Replenishment Solution (g) |
|---|---|---|
| 1-hydroxyethylidene-1,1-diphosphonate | 5.0 | 7.0 |
| Disodium Ethylene-diaminetetraacetate | 0.5 | 0.7 |
| Sodium Sulfite | 10.0 | 12.0 |
| Sodium Bisulfite | 8.0 | 10.0 |
| Ammonium Thiosulfate | 170.0 ml | 200.0 ml |

-continued

| | | |
|---|---|---|
| Aqueous Solution (700 g/l) | | |
| Ammonium Thiocyanate | 100.0 | 150.0 |
| Thiourea | 3.0 | 5.0 |
| 3,6-dithia-1,8-octanediol | 3.0 | 5.0 |
| Water to make | 1.0 l | 1.0 l |
| Ammonium acetate to adjust pH | 6.5 | 6.7 |

Stabilizing Solution:

| | Common to mother and replenishment solutions |
|---|---|
| Formalin (37%) | 1.2 ml |
| 5-chloro-2-methyl-4-isothiazoline-3-on | 6.0 mg |
| 2-methyl-4-isothiazoline-3-on | 3.0 mg |
| Surfactant $[C_{10}H_{21}-O-(CH_2CH_2O)_{10}-H]$ | 0.4 |
| Ethyleneglycol | 1.0 |
| Water to make | 1.0 l |
| pH | 5.0–7.0 |

As a result, the samples 203,207 and 208 containing the emulsions 5, 13 and 15 of the present invention, respectively, were totally superior to the other samples in sensitivity, latent image storage stability and image sharpness.

EXAMPLE 4

(1) Preparation of Emulsion

A potate-like silver iodobromide emulsion (AgI=1.5 mol %) having an average grain size of 0.7 μm was prepared from silver nitrate, potassium bromide and potassium iodide by a normal ammonia method, and the emulsion was desalted by a normal flocculation method, and gold-plus-sulfur sensitization was optimally performed by using chloroauric acid and a compound (A) described in Table F, thereby preparing an emulsion 41 as a comparative example.

An aqueous solution was obtained by dissolving 6 g of potassium bromide and 30 g of inert gelatin in 3.7 l of distilled water, and a 14% aqueous potassium bromide solution and a 20% aqueous silver nitrate solution were added to the above aqueous solution under stirring at constant flow rates, a temperature of 55° C. and a pBr of 1.0 over 45 seconds by a double jet method (in this addition (I), 2.40% of a total silver amount were consumed). An aqueous gelatin solution (17%, 300 cc) was added and the resultant solution mixture was stirred at 55° C., and a 20% aqueous silver nitrate solution was added at a constant flow rate until the pBr reached 1.40 (in this addition (II), 5.0% of the total silver amount were consumed). A 20% aqueous potassium bromide solution and a 33% aqueous silver nitrate solution were added to the resultant solution mixture over 42 minutes and 5 seconds by the double jet method (in this addition (III), 49.6% of the total silver amount were consumed). During this addition, the temperature and the pBr was maintained at 55° C. and 1.50, respectively. A solution containing 6.2 g of potassium iodide was added to the resultant solution mixture (addition IV). A 20% potassium bromide solution and a 33% aqueous silver nitrate solution were added to the resultant solution mixture by the double jet method over 37 minutes and 9 seconds this addition (V), 43% of the total silver amount were consumed). During the addition, the temperature and the pBr were maintained at 55° C. and 1.50, respectively. The silver nitrate amount used in this emulsion was 425 g. The resultant was desalted by a normal flocculation method and optically, chemically sensitized by using chloroauric acid and the compound (A), thereby preparing a tabular AgBrI (AgI=2.0 mol %) emulsion 42 having an average grain size/grain thickness ratio of 6.5 and a sphere-equivalent diameter of 0.7 μm.

Emulsions 43 to 58 were prepared following the same procedures as for the emulsion 2 except that in place of the compound (A) the compound I and/or the compound II of the present invention were added at various times as listed in Table 3. Note that the chemical sensitization was optimized by adjusting the amounts of chloroauric acid and the compound (A) and the ripening temperature and time upon ripening.

TABLE 3

| Emulsion Name | Addition Compound Formula (I) | Addition Time | Addition Amount [mol/total AgX 1 mol] | Addition Compound Dye | Addition Time | Addition Amount [mol/total AgX 1 mol] |
|---|---|---|---|---|---|---|
| Emulsion-43 | I-1 | Before Chemical Sensitization | $5 \times 10^{-5}$ | — | — | — |
| Emulsion-44 | I-6 | Before Chemical Sensitization | " | — | — | — |
| Emulsion-45 | — | — | — | II-6 | Before Chemical Sensitization | $4 \times 10^{-4}$ |
| Emulsion-46 | — | — | — | II-17 | Before Chemical Sensitization | " |
| Emulsion-47 | I-1 | Before Chemical Sensitization | $5 \times 10^{-5}$ | II-6 | After Chemical Sensitization | $4 \times 10^{-4}$ |
| Emulsion-48 | " | After Chemical Sensitization | $5 \times 10^{-5}$ | II-6 | Before Chemical Sensitization | " |
| Emulsion-49 | I-1 | Before Chemical Sensitization | $5 \times 10^{-5}$ | II-6 | Before Chemical Sensitization | $4 \times 10^{-4}$ |
| Emulsion-50 | " | Before Chemical Sensitization | " | " | Before Chemical Sensitization | $7 \times 10^{-5}$ |
| Emulsion-51 | " | Before Chemical Sensitization | " | " | Before Chemical Sensitization | $1 \times 10^{-3}$ |
| Emulsion-52 | " | Before | " | II-17 | Before | $3 \times 10^{-4}$ |

TABLE 3-continued

| Emulsion Name | Addition Compound Formula (I) | Addition Time | Addition Amount [mol/total AgX 1 mol] | Addition Compound Dye | Addition Time | Addition Amount [mol/total AgX 1 mol] |
|---|---|---|---|---|---|---|
| | | Chemical Sensitization | | | Chemical Sensitization | |
| Emulsion-53 | " | Before Chemical Sensitization | " | II-5 | Before Chemical Sensitization | $2 \times 10^{-4}$ |
| | | | | II-6 | Before Chemical Sensitization | $3 \times 10^{-4}$ |
| Emulsion-54 | I-6 | Before Chemical Sensitization | " | II-6 | Before Chemical Sensitization | $4 \times 10^{-4}$ |
| Emulsion-55 | " | Before Chemical Sensitization | " | II-17 | Before Chemical Sensitization | $3 \times 10^{-4}$ |
| Emulsion-56 | I-1 | When 85% of Total Silver Nitrate Was Added During Grain Formation | $5 \times 10^{-4}$ | II-6 | Before Chemical Sensitization | $4 \times 10^{-4}$ |
| Emulsion-57 | " | When 85% of Total Silver Nitrate Was Added During Grain Formation | " | II-6 | When 85% Of Total Silver Nitrate Was Added During Grain Formation | $1 \times 10^{-3}$ |
| Emulsion-58 | I-1 | Before Chemical Sensitization | $5 \times 10^{-4}$ | II-6 | Before Chemical Sensitization | $3 \times 10^{-3}$ |

(2) Preparation of Coating Sample

Dodecylbenzenesulfonate as a coating aid, vinylbenzenesulfonate as a thickening agent, a vinylsulfone-based compound as a film hardener and a polyethyleneoxide-based compound as a photographic property improving agent were added to each of the emulsions prepared in item (1) above, thereby preparing an emulsion coating solution. Subsequently, the prepared coating solution were independently, uniformly coated on undercoated polyester bases, and a surface protective layer mainly consisting of an aqueous gelatin solution was coated thereon, thereby preparing coating samples 41 to 58 having the emulsions 41 to 58, respectively. In each of the samples 41 to 58, a coating silver amount was 4.0 g/m$^2$, a gelatin coating amount of the protective layer was 1.3 g/m$^2$ and a gelatin coating amount of the emulsion layer was 2.7 g/m$^2$.

(3) Evaluation of Coating Sample

Sample pieces of the coating samples 41 to 58 prepared as described above were wedge-exposed for an exposure time of 1/100 sec with an exposure amount of 50 CMS and simultaneously developed by using the developer I of Example 1 at 20° C. for 4'. After the developed samples were fixed, washed and dried, sensitometry was performed to obtain photographic sensitivities by a reciprocal of an exposure amount for providing density of fog+0.1.

Three sample pieces were prepared from each of the coating samples 41 to 58. One sample piece was stored at 55° C. and 30% RH for three days, another sample piece was stored at 55° C. and 80% RH for three days, and the remaining sample piece was stored at room temperature to be used as a control. These sample pieces were developed as described above to evaluate an incubation resistance.

Three sample pieces were prepared from each of the coating samples 41 to 58 and wedge-exposed for 1/100". Thereafter, one sample piece was stored at 50° C. and 30% RH for three days, another sample piece was stored at 50° C. and 80% RH for three days, and the remaining sample piece was stored in a freezer to be used as a control. These samples pieces were developed as described above to evaluate storage stability of latent image.

The results are summarized in Table 4.

TABLE 4

| Coating Sample No. | Emulsion Name | *) Sensitivity | Incubation Resistance**) (%) 55° C., 33% RH | Incubation Resistance**) (%) 55° C., 80% RH | Latent Image Storage Stability***) (%) 55° C., 30% RH | Latent Image Storage Stability***) (%) 55° C., 80% RH | Remarks |
|---|---|---|---|---|---|---|---|
| 41 | Emulsion-41 | 90 | 110 | 85 | 90 | 90 | Comparative Example |
| 42 | Emulsion-42 | 100 | 120 | 70 | 70 | 50 | Comparative Example |
| 43 | Emulsion-43 | 92 | 115 | 70 | 98 | 90 | Comparative Example |
| 44 | Emulsion-44 | 92 | 115 | 70 | 95 | 92 | Comparative Example |
| 45 | Emulsion-45 | 115 | 115 | 80 | 70 | 50 | Comparative Example |
| 46 | Emulsion-46 | 130 | 115 | 80 | 70 | 45 | Comparative |

TABLE 4-continued

| Coating Sample No. | Emulsion Name | *) Sensitivity | Incubation Resistance**) (%) 55° C., 33% RH | 55° C., 80% RH | Latent Image Storage Stability***) (%) 55° C., 30% RH | 55° C., 80% RH | Remarks |
|---|---|---|---|---|---|---|---|
| 47 | Emulsion-47 | 105 | 115 | 65 | 98 | 92 | Example Comparative |
| 48 | Emulsion-48 | 20 | 110 | 60 | 70 | 45 | Example Comparative |
| 49 | Emulsion-49 | 110 | 105 | 98 | 98 | 92 | Example Present Invention |
| 50 | Emulsion-50 | 105 | 115 | 75 | 98 | 92 | Comparative Example |
| 51 | Emulsion-51 | 110 | 105 | 95 | 98 | 92 | Present Invention |
| 52 | Emulsion-52 | 125 | 100 | 95 | 98 | 90 | Present Invention |
| 53 | Emulsion-53 | 120 | 100 | 98 | 95 | 95 | Present Invention |
| 54 | Emulsion-54 | 115 | 105 | 95 | 95 | 92 | Present Invention |
| 55 | Emulsion-55 | 120 | 100 | 98 | 95 | 92 | Present Invention |
| 56 | Emulsion-56 | 115 | 105 | 98 | 95 | 92 | Present Invention |
| 57 | Emulsion-57 | 115 | 103 | 98 | 98 | 95 | Present Invention |
| 58 | Emulsion-58 | 100 | 102 | 90 | 98 | 90 | Present Invention |

*) The sensitivity is represented as relative sensitivity assuming that sensitivity of the fresh sample 42 is 100.
**) The latent image storage stability is represented by a relative value of sensitivity assuming that the sensitivity of a control of each sample is 100.

As is apparent from Table 4, each emulsion of the present invention has comparatively high sensitivity, a high incubation resistance and good latent image storage stability due to the effects of the present invention.

EXAMPLE 5

Preparation of Sample 501

A plurality of layers having the following compositions were formed on a 127-μm thick undercoated triacetylcellulose film support to prepare a sample 501 as a multilayer color light-sensitive material. Numerals represent addition amounts per $m^2$.

| | |
|---|---|
| Layer 1: Antihalation Layer: | |
| Black Colloidal Silver | 0.25 g |
| Gelatin | 1.9 g |
| U-1 | 0.04 g |
| U-2 | 0.1 g |
| U-3 | 0.1 g |
| Oil-1 | 0.1 g |
| Layer 2: Interlayer | |
| Gelatin | 0.40 g |
| Cpd-D | 10 mg |
| Oil-3 | 40 mg/$m^2$ |
| Layer 3: Interlayer | |
| Surface-Fogged Fine Grain Silver Iodobromide Emulsion (average grain size = 0.06 μm, AgI content = 1 mol %) silver | 0.05 g |
| Gelatin | 0.4 g |
| Layer 4: Low-Sensitivity Red-Sensitive Emulsion Layer: | |
| Silver Iodobromide Emulsion (a 1:1 mixture of a monodisperse cubic emulsion having an average grain size of 0.4 μm and an AgI content of 4.5 mol % and a monodisperse cubic emulsion having an average grain size of 0.3 μm and an AgI content of 4.5 mol %) Spectrally Sensitized with Sensitizing Dyes S-1 and S-2 silver | 0.4 g |
| Gelatin | 0.8 g |
| Coupler C-1 | 0.20 g |

-continued

| | |
|---|---|
| Coupler C-9 | 0.05 g |
| Oil-1 | 0.1 cc |
| Layer 5: Medium-Sensitivity Red-Sensitive Emulsion Layer: | |
| Silver Iodobromide Emulsion (a monodisperse cubic emulsion having an average grain size of 0.5 μm and an AgI content of 4 mol %) Spectrally Sensitized with Sensitizing Dyes S-1 and S-2 silver | 0.4 g |
| Gelatin | 0.8 g |
| Coupler C-1 | 0.2 g |
| Coupler C-2 | 0.05 g |
| Coupler C-3 | 0.2 g |
| Oil-1 | 0.1 cc |
| Layer 6: High-Sensitivity Red-Sensitive Emulsion Layer: | |
| Silver Iodobromide Emulsion (a monodisperse twined grain emulsion having an average grain size of 0.7 μm and an AgI content of 2 mol %) Spectrally Sensitized with Sensitizing Dyes S-1 and S-2 silver | 0.4 g |
| Gelatin | 1.1 g |
| Coupler C-3 | 0.7 g |
| Coupler C-1 | 0.3 g |
| Layer 7: Interlayer: | |
| Gelatin | 0.6 g |
| Dye D-1 | 0.02 g |
| Layer 8: Interlayer: | |
| Surface-Fogged Silver Iodobromide Emulsion (average grain size = 0.06 μm, AgI content = 0.3 mol %) | |
| Gelatin | 1.0 g |
| Cpd A | 0.2 g |
| Layer 9: Low-Sensitivity Green-Sensitive Emulsion Layer: | |
| Silver Iodobromide Emulsion (a 1:1 mixture of a monodisperse cubic emulsion having an average grain size of 0.4 μm and an AgI content of 4.5 mol % and a monodisperse cubic emulsion having an average grain size of 0.2 μm and an AgI content of 4.5 mol %) Spectrally Sensitized with Sensitizing Dyes S-3 and S-4 silver | 0.5 g |

-continued

| | |
|---|---|
| Gelatin | 0.5 g |
| Coupler C-4 | 0.10 g |
| Coupler C-7 | 0.10 g |
| Coupler C-8 | 0.10 g |
| Cpd-B | 0.03 g |
| Cpd-E | 0.1 g |
| Cpd-F | 0.1 g |
| Cpd-G | 0.1 g |
| Cpd-H | 0.1 g |
| Layer 10: Medium-Sensitivity Green-Sensitive Emulsion Layer: | |
| Silver Iodobromide Emulsion (monodisperse cubic emulsion having an average grain size of 0.5 μm and an AgI content of 3 mol %) Spectrally Sensitized with Sensitizing Dyes S-3 and S-4 silver | 0.4 g |
| Gelatin | 0.6 g |
| Coupler C-4 | 0.1 g |
| Coupler C-7 | 0.1 g |
| Coupler C-8 | 0.1 g |
| Cpd-B | 0.03 g |
| Cpd-E | 0.1 g |
| Cpd-F | 0.1 g |
| Cpd-G | 0.05 g |
| Cpd-H | 0.05 g |
| Layer 11: High-Sensitivity Green-Sensitive Emulsion Layer: | |
| Silver Iodobromide Emulsion (the emulsion 2 described in Example 4) Spectrally Sensitized with Sensitizing Dyes S-7 and S-4 silver | 0.5 g |
| Gelatin | 1.0 g |
| Coupler C-4 | 0.4 g |
| Coupler C-7 | 0.2 g |
| Coupler C-8 | 0.2 g |
| Cpd-B | 0.08 g |
| Cpd-E | 0.1 g |
| Cpd-F | 0.1 g |
| Cpd-G | 0.1 g |
| Cpd-H | 0.1 g |
| Layer 12: Interlayer: | |
| Gelatin | 0.6 g |
| Dye D-2 | 0.05 g |
| Layer 13: Yellow Filter Layer: | |
| Yellow Colloidal Silver silver | 0.1 g |
| Gelatin | 1.1 g |
| Cpd-A | 0.01 g |
| Layer 14: Interlayer: | |
| Gelatin | 0.6 g |
| Layer 15: Low-Sensitivity Blue-Sensitive Emulsion Layer: | |
| Silver Iodobromide Emulsion (a 1:1 mixture of a monodisperse cubic emulsion having an average grain size of 0.4 μm and an AgI content of 3 mol % and an monodisperse cubic emulsion having an average grain size of 0.2 μm and an AgI content of 3 mol %) Sensitized with Sensitizing Dyes S-5 and S-6 silver | 0.6 g |
| Gelatin | 0.8 g |
| Coupler C-5 | 0.6 g |
| Layer 16: Medium-Sensitivity Blue-Sensitive Emulsion Layer: | |
| Silver Iodobromide Emulsion (monodisperse cubic emulsion having an average grain size of 0.5 μm and an AgI content of 2 mol %) Sensitized with Sensitizing Dyes S-5 and S-6 silver | 0.4 g |
| Gelatin | 0.9 g |
| Coupler C-5 | 0.3 g |
| Coupler C-6 | 0.3 g |
| Layer 17: High-Sensitivity Blue-Sensitive Emulsion Layer: | |
| Silver Iodobromide Emulsion (the emulsion 2 described in Example 4) Sensitized with Sensitizing Dyes S-5 and S-6 silver | 0.4 g |
| Gelatin | 1.2 g |
| Coupler C-6 | 0.7 g |
| Layer 18: lst Protective Layer: | |
| Gelatin | 0.7 g |
| U-1 | 0.04 g |

-continued

| | |
|---|---|
| U-3 | 0.03 g |
| U-4 | 0.03 g |
| U-5 | 0.05 g |
| U-6 | 0.05 g |
| Cpd-C | 0.8 g |
| Dye D-3 | 0.05 g |
| Layer 19: 2nd Protective Layer: | |
| Fogged Fine Grain Silver Iodobromide Emulsion (average grain size = 0.06 μm, AgI content = 1 mol %) silver | 0.1 g |
| Gelatin | 0.4 g |
| Layer 20: 3rd Protective Layer: | |
| Gelatin | 0.4 g |
| Polymethyl Methacrylate (average grain size = 1.5 μm) | 0.1 g |
| 4:6 Copolymer of Methyl Methacrylate and Acrylic Acid (average grain size = 1.5 μm) | 0.1 g |
| Silicone Oil | 0.03 g |
| Surfactant W-1 | 3.0 mg |

A gelatin hardener H-1 and a surfactant for coating and emulsification were added to each layer in addition to the above compositions. Formulas of the compounds except for those used in Example 2 are listed in Table G to be presented later.

A sample 502 was prepared following the same procedures as for the sample 501 except that the emulsion 12 described in Example 4 was used in the high-sensitivity green-sensitive emulsion layer and that the emulsion 13 described in Example 4 was used in the high-sensitivity blue-sensitive emulsion layer.

Sample pieces of the samples 501 and 502 prepared as described above were subjected to exposure (+incubation) by the method described in item (3) of Example 4 and developed following the same procedures as in Example 1.

The color reversal sensitivities of the high-sensitivity green-sensitive layer and the high-sensitivity blue-sensitive layer were estimated on the basis of a relative exposure amount required for the density larger by 2.0 than a minimum density of the magenta and yellow densities.

As a result, as in Example 4, the sample 502 was superior to the sample 501 in sensitivity, incubation resistance and latent image storage stability of the high-sensitivity green- and blue-sensitive layers due to the significant effects of the present invention.

EXAMPLE 6

A sample 601 as a multilayer color light-sensitive material was manufactured.

(Light-Sensitive Layer Composition)

Numerals corresponding to the the respective components indicate coating amounts in units of g/m$^2$. The amount of silver halide is represented in a silver-converted coated amount. A coating amount of the sensitizing dye is represented in units of mols per mol of the silver halide in the same layer.

| (Sample 601 | |
|---|---|
| Layer 1: Antihalation Layer | |
| Black Colloid Silver silver | 0.18 |
| Gelatin | 1.40 |
| Layer 2: Interlayer | |
| 2,5-di-t-pentadecylhydroquinone | 0.18 |
| EX-1 | 0.07 |
| EX-3 | 0.02 |
| EX-12 | 0.002 |

-continued (Sample 601

| | |
|---|---|
| U-1 | 0.06 |
| U-2 | 0.08 |
| U-3 | 0.10 |
| HBS-1 | 0.10 |
| HBS-2 | 0.02 |
| Gelatin | 1.04 |
| Layer 3: 1st Red-Sensitive Emulsion Layer | |
| Emulsion A silver | 0.25 |
| Emulsion B silver | 0.25 |
| Sensitizing Dye I | $6.9 \times 10^{-5}$ |
| Sensitizing Dye II | $1.8 \times 10^{-5}$ |
| Sensitizing Dye III | $3.1 \times 10^{-4}$ |
| EX-2 | 0.335 |
| EX-10 | 0.020 |
| HBS-1 | 0.060 |
| Gelatin | 0.87 |
| Layer 4: 2nd Red-Sensitive Emulsion Layer | |
| Emulsion G silver | 1.0 |
| Sensitizing Dye I | $5.1 \times 10^{-5}$ |
| Sensitizing Dye II | $1.4 \times 10^{-5}$ |
| Sensitizing Dye III | $2.3 \times 10^{-4}$ |
| EX-2 | 0.400 |
| EX-3 | 0.050 |
| EX-10 | 0.015 |
| HBS-1 | 0.060 |
| Gelatin | 1.30 |
| Layer 5: 3rd Red-Sensitive Emulsion Layer | |
| Emulsion D silver | 1.60 |
| Sensitizing Dye I | $5.4 \times 10^{-5}$ |
| Sensitizing Dye II | $1.4 \times 10^{-5}$ |
| Sensitizing Dye III | $2.4 \times 10^{-4}$ |
| EX-3 | 0.010 |
| EX-4 | 0.080 |
| EX-2 | 0.097 |
| HBS-1 | 0.22 |
| HBS-2 | 0.10 |
| Gelatin | 1.63 |
| Layer 6: Interlayer | |
| EX-5 | 0.040 |
| HBS-1 | 0.020 |
| Gelatin | 0.80 |
| Layer 7: 1st Green-Sensitive Emulsion Layer | |
| Emulsion A silver | 0.15 |
| Emulsion B silver | 0.15 |
| Sensitizing Dye V | $3.0 \times 10^{-5}$ |
| Sensitizing Dye VI | $1.0 \times 10^{-4}$ |
| Sensitizing Dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-3 | 0.010 |
| Gelatin | 0.63 |
| Layer 8: 2nd Green-Sensitive Emulsion Layer | |
| Emulsion C silver | 0.45 |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| EX-6 | 0.094 |
| EX-8 | 0.018 |

-continued (Sample 601

| | |
|---|---|
| EX-7 | 0.026 |
| HBS-1 | 0.160 |
| HBS-3 | 0.008 |
| Gelatin | 0.50 |
| Layer 9: 3rd Green-Sensitive Emulsion Layer | |
| Emulsion E silver | 1.2 |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| EX-13 | 0.015 |
| EX-11 | 0.100 |
| EX-1 | 0.025 |
| HBS-1 | 0.25 |
| HBS-2 | 0.10 |
| Gelatin | 1.54 |
| Layer 10: Yellow Filter Layer | |
| Yellow Colloid Silver silver | 0.05 |
| EX-5 | 0.08 |
| HBS-3 | 0.03 |
| Gelatin | 0.95 |
| Layer 11: 1st Blue-Sensitive Emulsion Layer | |
| Emulsion A silver | 0.08 |
| Emulsion B silver | 0.07 |
| Emulsion F silver | 0.07 |
| Sensitizing Dye VIII | $3.5 \times 10^{-4}$ |
| EX-9 | 0.721 |
| EX-8 | 0.042 |
| HBS-1 | 0.28 |
| Gelatin | 1.10 |
| Layer 12: 2nd Blue-Sensitive Emulsion Layer | |
| Emulsion G silver | 0.45 |
| Sensitizing Dye VIII | $2.1 \times 10^{-4}$ |
| EX-9 | 0.154 |
| EX-10 | 0.007 |
| HBS-1 | 0.05 |
| Gelatin | 0.78 |
| Layer 13: 3rd Blue-Sensitive Emulsion Layer | |
| Emulsion H silver | 0.77 |
| Sensitizing Dye VIII | $2.2 \times 10^{-4}$ |
| EX-9 | 0.20 |
| HBS-1 | 0.07 |
| Gelatin | 0.69 |
| Layer 14: 1st Protective Layer | |
| Emulsion I silver | 0.5 |
| U-4 | 0.11 |
| U-5 | 0.17 |
| HBS-1 | 0.05 |
| Gelatin | 1.00 |
| Layer 15: 2nd Protective Layer | |
| Polymethylacrylate Grains (diameter = about 1.5 μm) | 0.54 |
| S-1 | 0.20 |
| Gelatin | 1.20 |

In addition to the above components, a gelatin hardener H-1 and a surfactant were added to each layer. The emulsions A to I used in this example are listed in the following table, and the formulas or names of the compounds used in this example are listed in Table H to be presented later.

| | Average AgI Content (%) | Average Grain Size (μm) | Variation Coefficient of Grain Size (%) | Diameter/ Thickness Ratio | Silver Amount Ratio (AgI Content %) |
|---|---|---|---|---|---|
| Emulsion A | 4.1 | 0.45 | 27 | 1 | Core/Shell = ⅓(13/1), Double Structure Grain |
| Emulsion B | 8.9 | 0.70 | 14 | 1 | Core/Shell = 3/7(25/2), Double Structure Grain |
| Emulsion C | 10 | 0.75 | 30 | 2 | Core/Shell = ½(24/3), Double Structure Grain |
| Emulsion D | 16 | 1.05 | 35 | 2 | Core/Shell = ½(40/0), Double Structure Grain |
| Emulsion E | 10 | 1.05 | 35 | 3 | Core/Shell = ½(24/3), Double Structure Grain |

-continued

| | Average AgI Content (%) | Average Grain Size (μm) | Variation Coefficient of Grain Size (%) | Diameter/ Thickness Ratio | Silver Amount Ratio (AgI Content %) |
|---|---|---|---|---|---|
| Emulsion F | 4.1 | 0.25 | 28 | 1 | Core/Shell = ½(13/1), Double Structure Grain |
| Emulsion G | 13.6 | 0.75 | 25 | 2 | Core/Shell = ½(40/0), Double Structure Grain |
| Emulsion H | 14 | 1.30 | 25 | 3 | Core/Shell = 37/63(34/3), Double Structure Grain |
| Emulsion I | 1 | 0.07 | 15 | 1 | Uniform Grain |

Samples 602 to 607 were formed following the same procedures as for the sample 601 except that the emulsion G in the 2nd blue-sensitive layer was replaced by the emulsions 2, 9, 11, 13, 14 and 17 described in Example 4 and no sensitizing dye was added to the emulsions 9, 11, 13, 14 and 17. Sample pieces of the obtained samples 601 to 607 were subjected to exposure (+incubation) for sensitivity measurement and incubation resistance and latent image storage stability evaluation by the method described in item (3) of Example 4 and developed by an automatic developing machine following the same procedures as in Example 3. The sample pieces of the samples 601 to 607 were subjected to an MTF measuring wedge exposure and processed following the same procedures as in Example 3. As a result, the samples 603 to 607 containing the emulsions 9, 11, 13, 14 and 17 of the present invention were totally superior to the other samples in incubation resistance, latent image storage stability and image sharpness.

As has been described above, according to the present invention, a silver halide photographic light-sensitive material with good image sharpness and latent image storage stability can be obtained.

The light-sensitive material can maintain its extremely stable properties even if it is stored at a high temperature and a low humidity or at a high temperature and a high humidity. Usefulness of the present invention is great.

TABLE A (1)

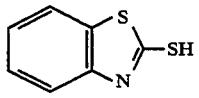

TABLE A-continued (2)

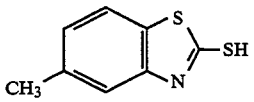

(3)

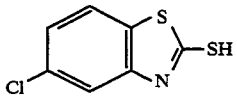

(4)

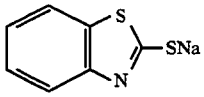

(5)

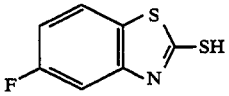

(6)

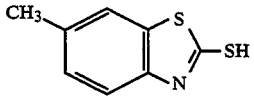

(7)

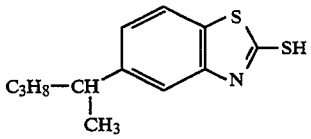

(8)

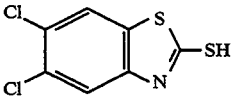

TABLE B

II-1

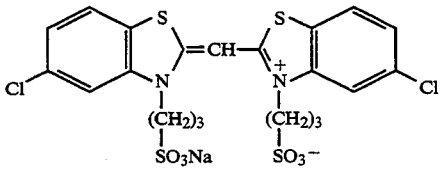

II-2

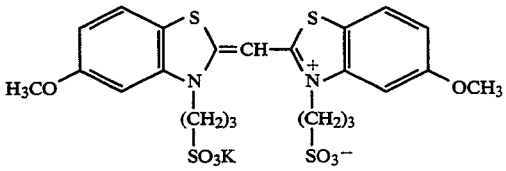

TABLE B-continued
II-3
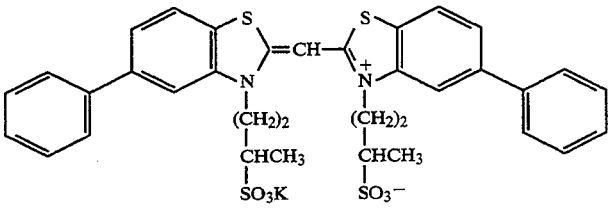
II-4
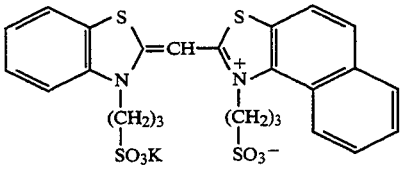
II-5
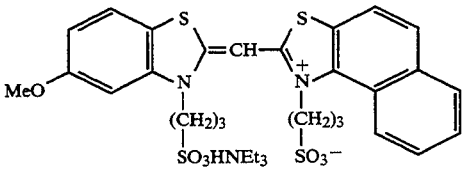
II-6
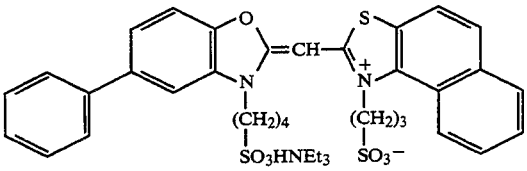
II-7
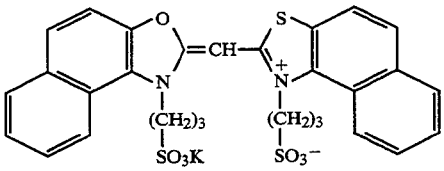
II-8
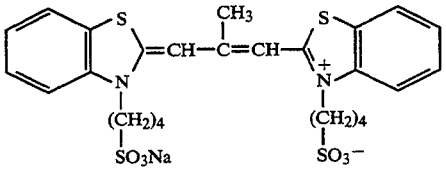
II-9
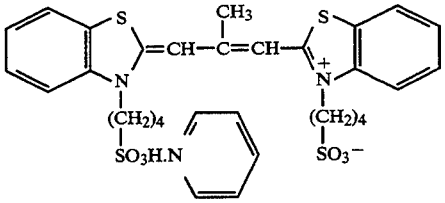
II-10
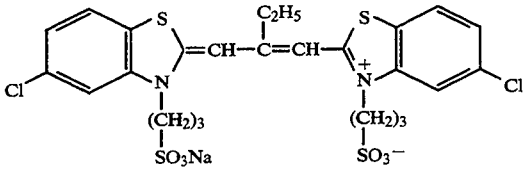

TABLE B-continued
II-11
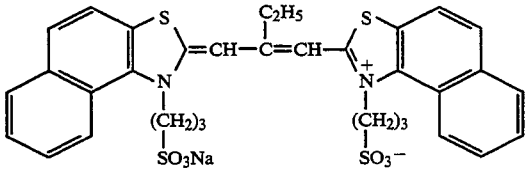
II-12
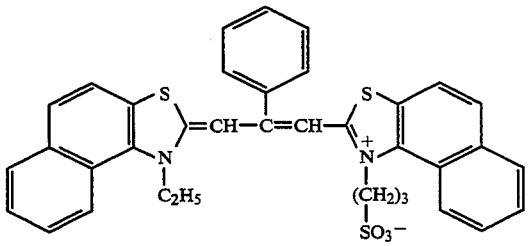
II-13
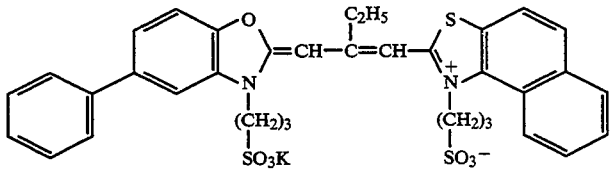
II-14
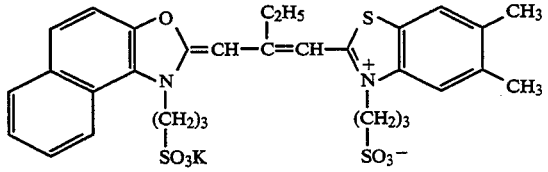
II-15
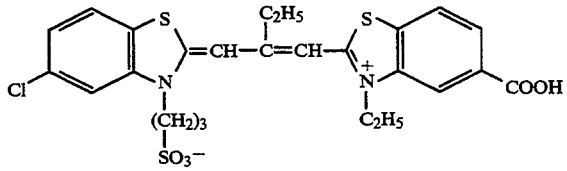
II-16
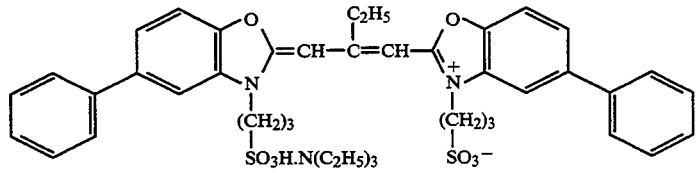
II-17
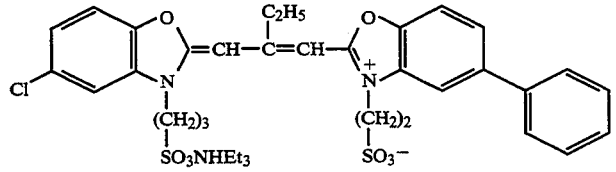
II-18
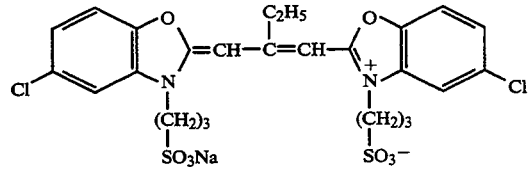

TABLE B-continued
II-19
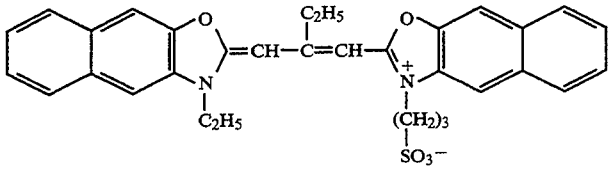
II-20
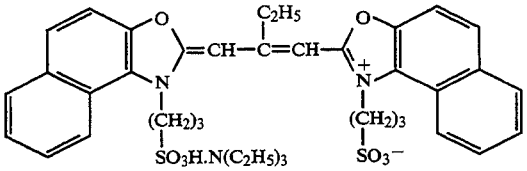
II-21
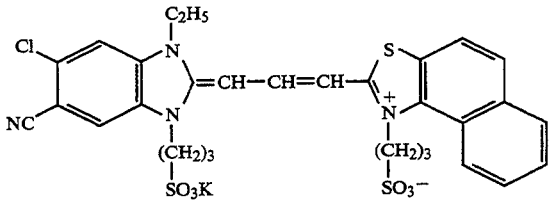
II-22
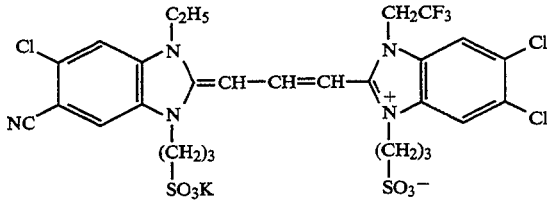
II-23
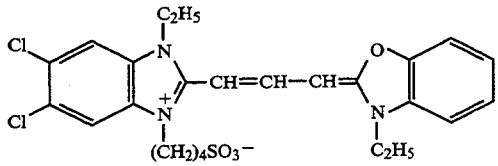
II-24
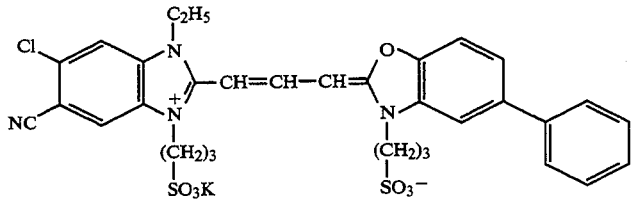
II-25
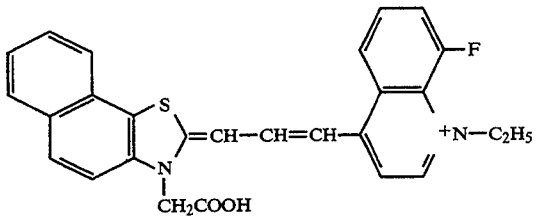
II-26
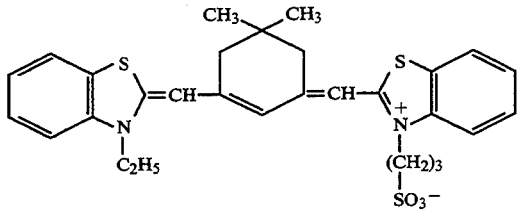

TABLE B-continued
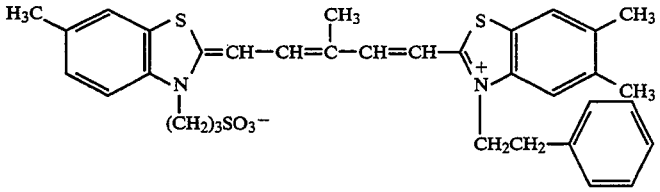
II-27
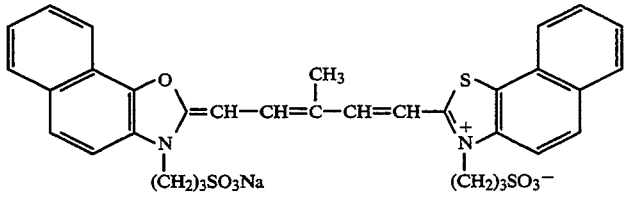
II-28
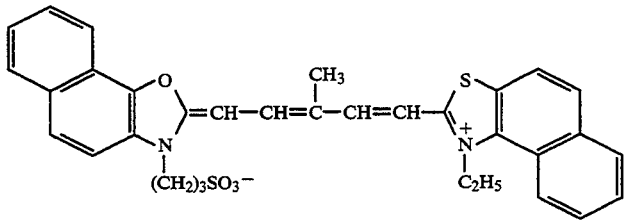
II-29
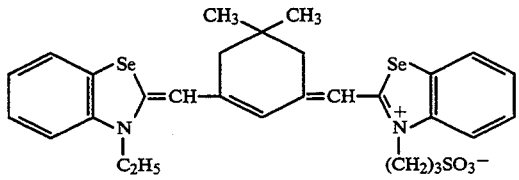
II-30
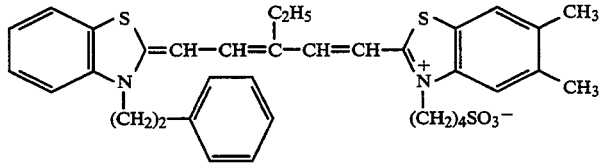
II-31
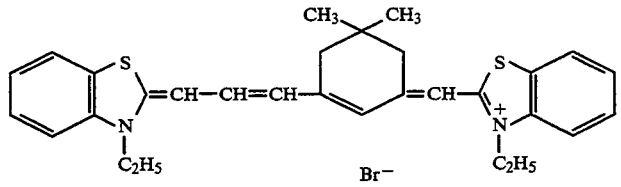
II-32
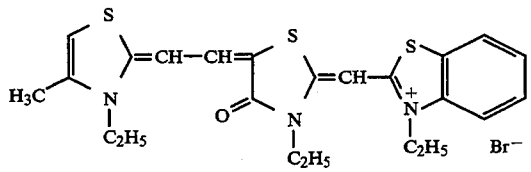
II-33

TABLE B-continued
II-34
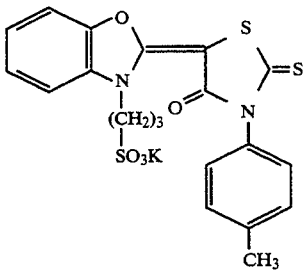
II-35
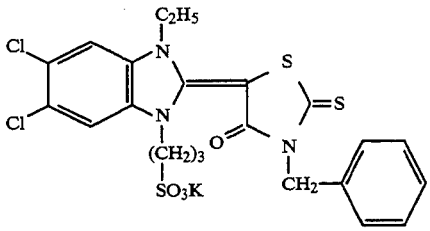
II-36
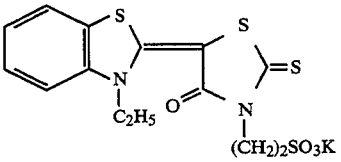
II-37
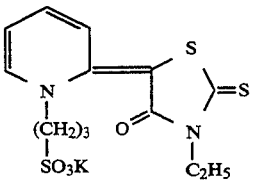
II-38
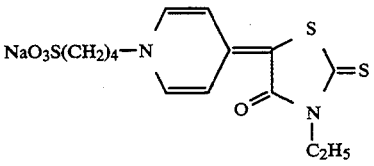
II-39
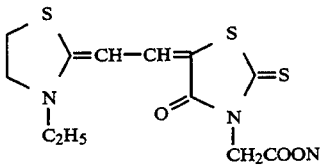
II-40
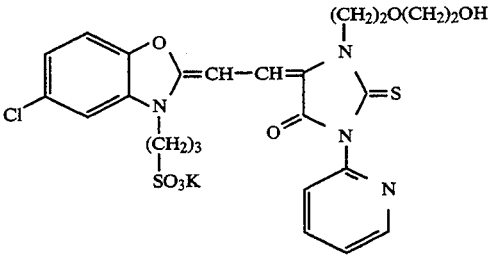

TABLE B-continued
II-41
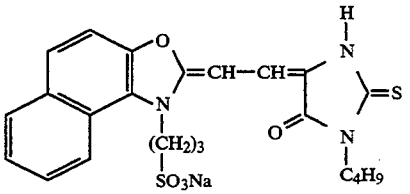
II-42
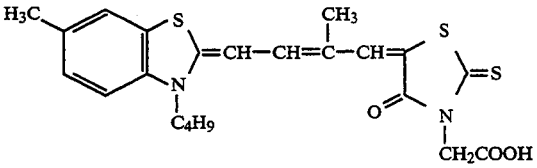
II-43
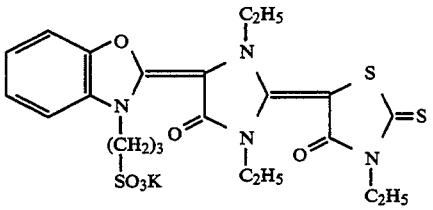
II-44
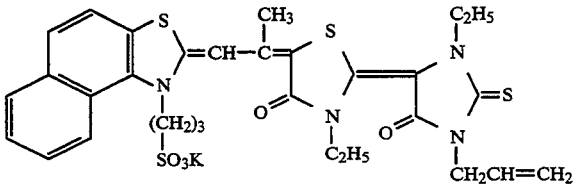
II-45
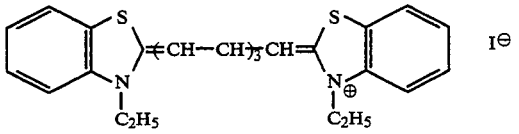
II-46
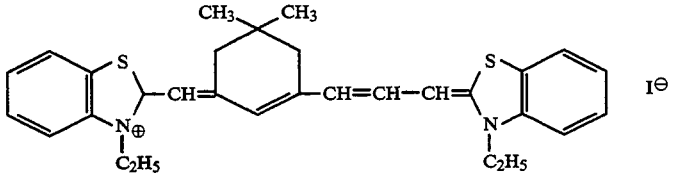
II-47
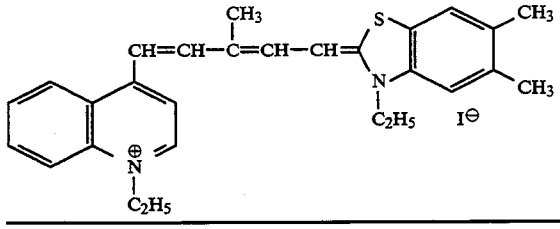
TABLE C
Compound - (A)
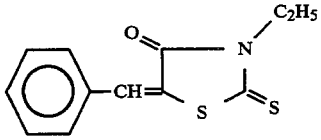
TABLE C-continued
Compound - (B)
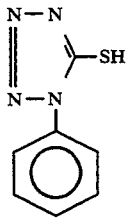

TABLE C-continued
Compound - (C)
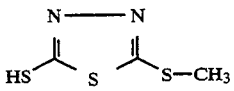
Compound - (D)
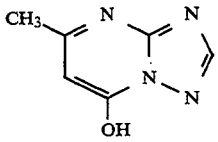
TABLE C-continued
S-5
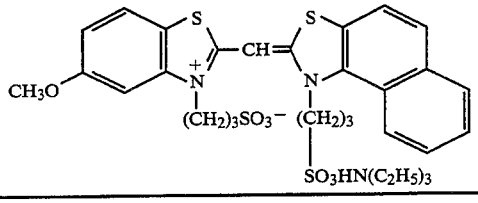
TABLE D
C-1
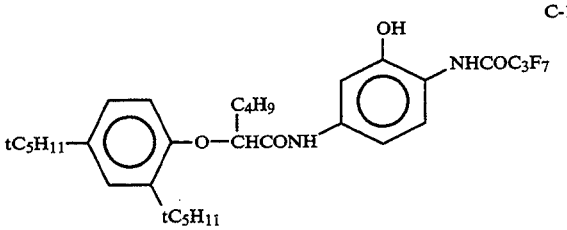
C-2
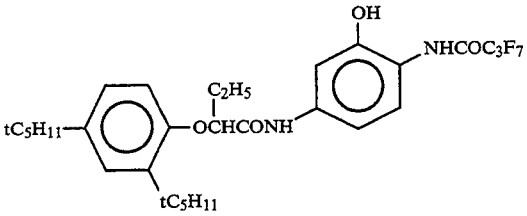
C-3
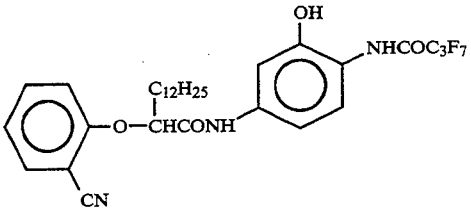
C-4
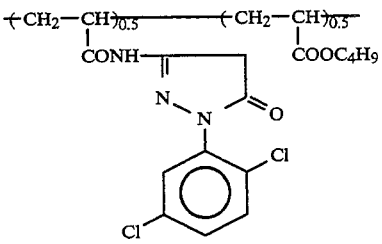
C-5
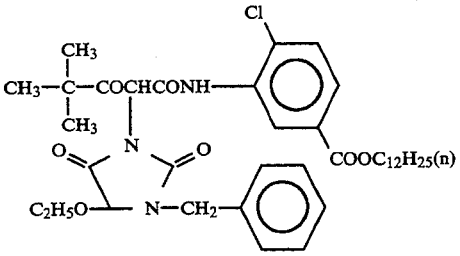
C-6
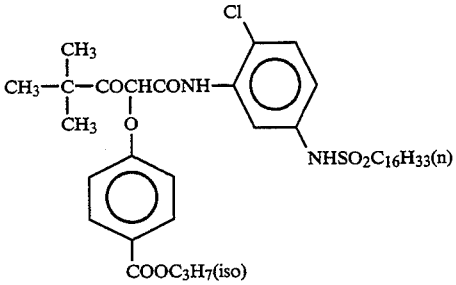
S-1
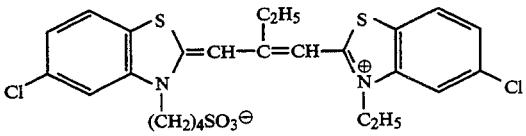
S-2
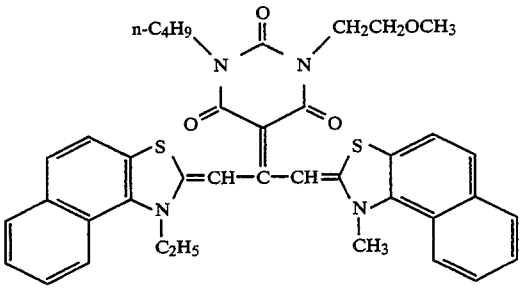
S-3
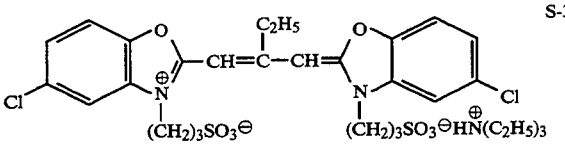
S-4
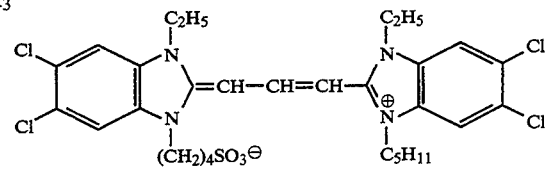

TABLE D-continued
| | | | |
|---|---|---|---|
| 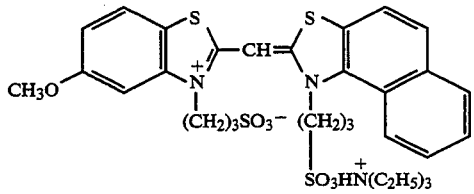 | S-5 | 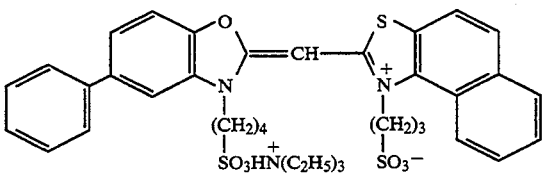 | S-6 |
| 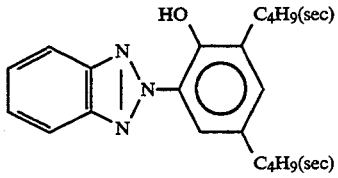 | U-1 | 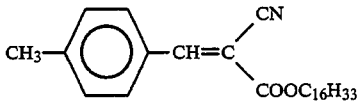 | U-2 |
| 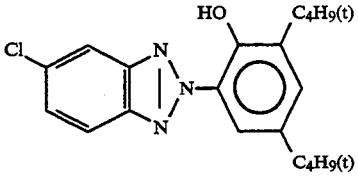 | U-3 | 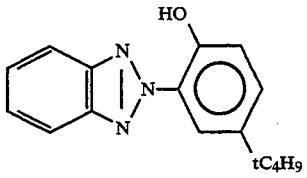 | U-4 |
| 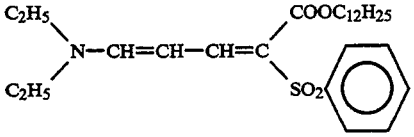 | U-5 | 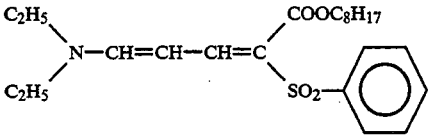 | U-6 |
| dibutyl phthalate | Oil 1 | tricresyl phosphate | Oil 2 |
| 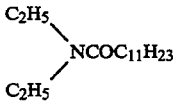 | Oil 3 | 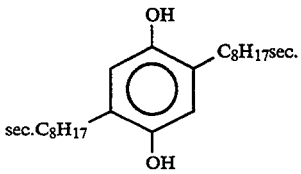 | Cpd A |
| 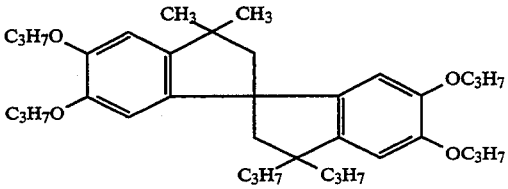 | Cpd B | 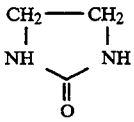 | Cpd C |
| 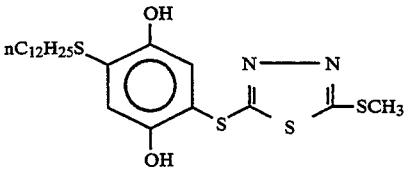 | | | Cpd D |
| 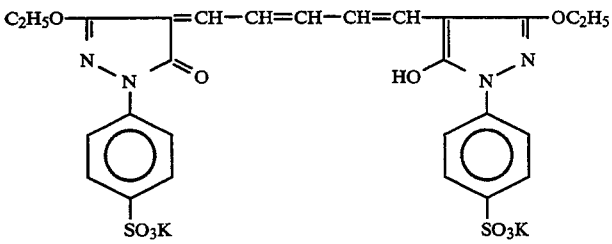 | | | D-1 |

TABLE E
EX-1
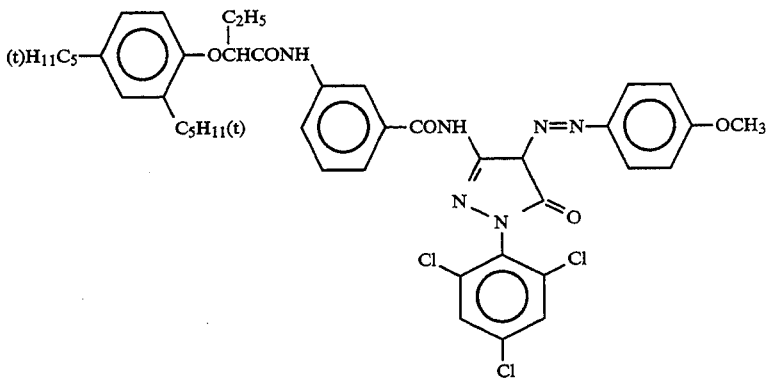
EX-2
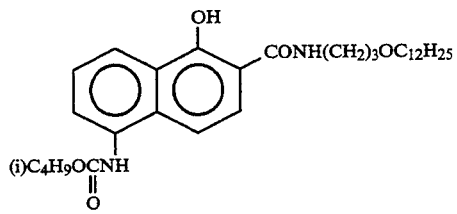
EX-3
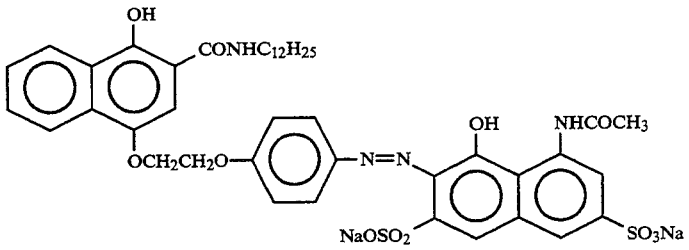
EX-4
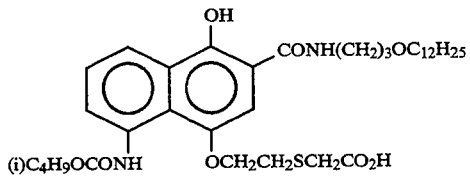
EX-5
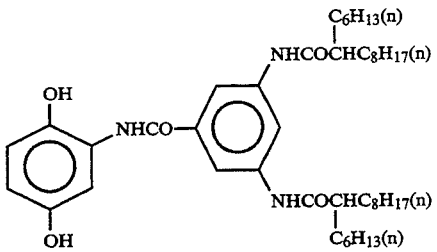

TABLE E-continued
EX-6
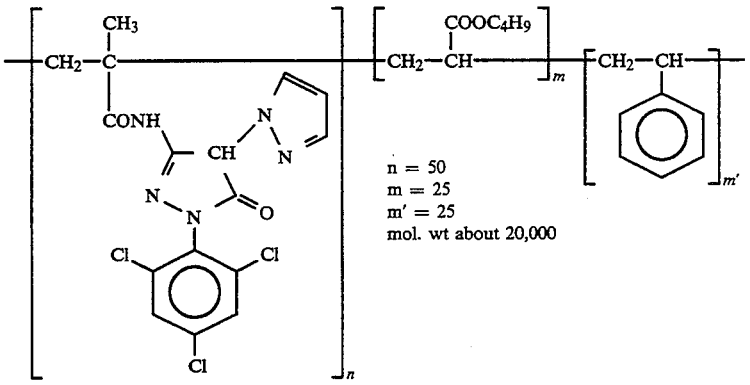
EX-7
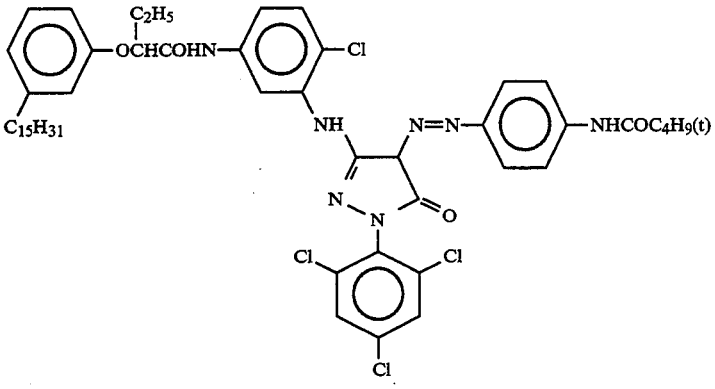
EX-8
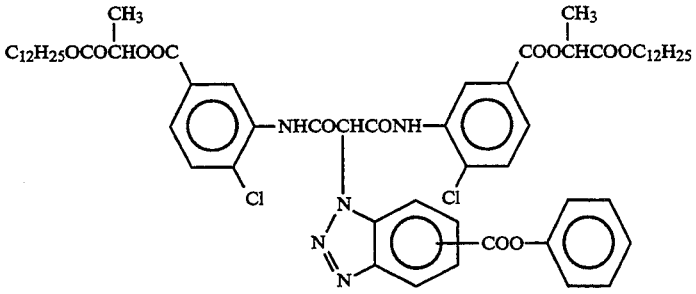
EX-9
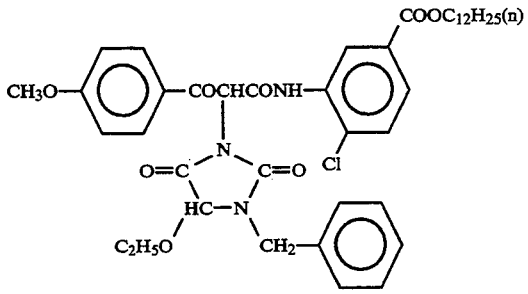

TABLE E-continued
EX-10
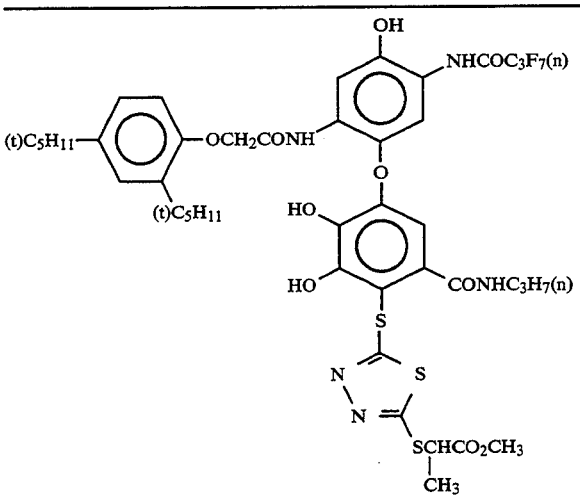
EX-11
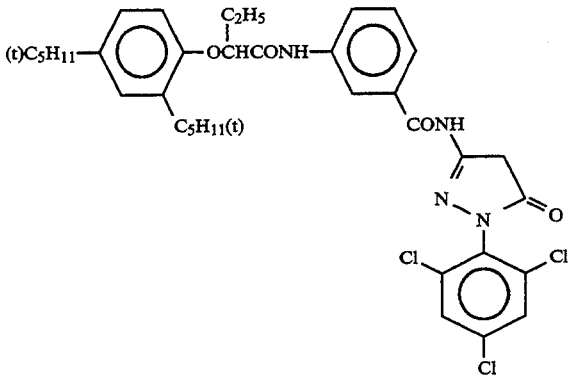
EX-12
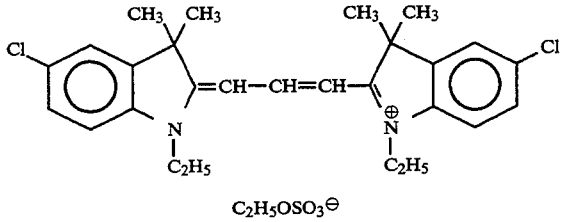
EX-13
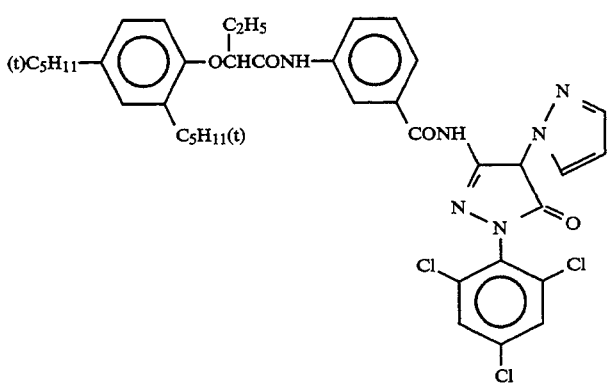
U-1
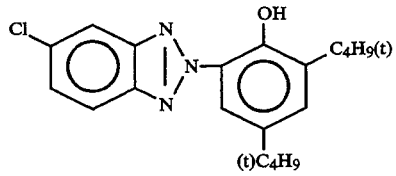

TABLE E-continued
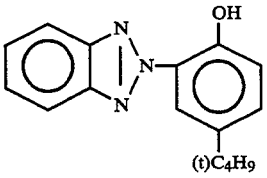
U-2
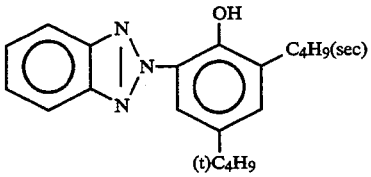
U-3
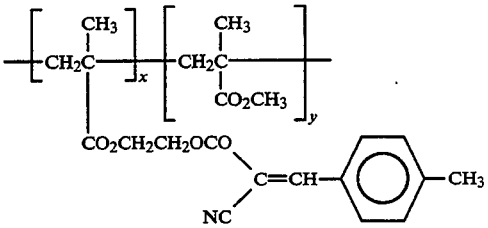
x:y = 70:30 (wt %)
U-4
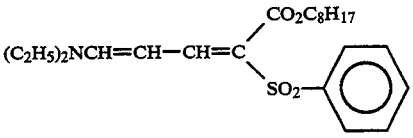
UV-5
tricresyl phosphate HBS-1
di-n-butyl phtalate HBS-2
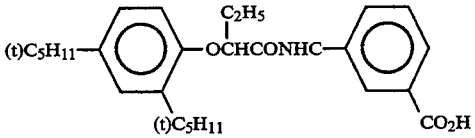
HBS-3
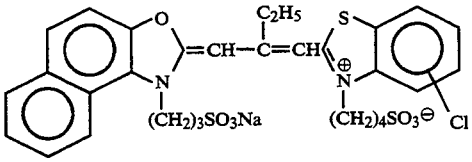
Sensitizing dye I
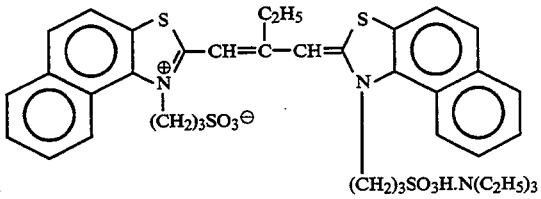
Sensitizing dye II
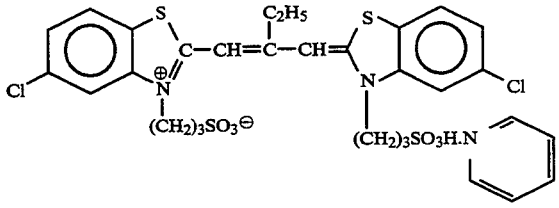
Sensitizing dye III TABLE E-continued
| | |
|---|---|
| 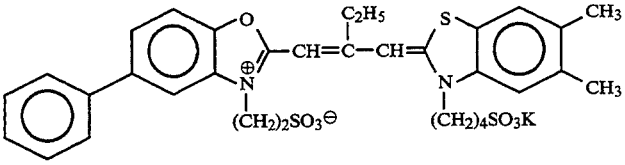 | Sensitizing dye V |
| 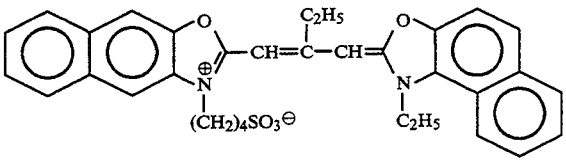 | Sensitizing dye VI |
| 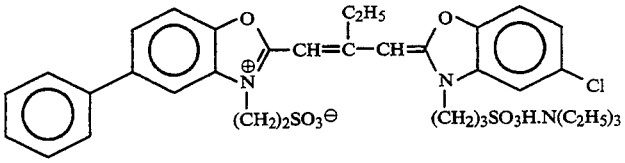 | Sensitizing dye VII |
| 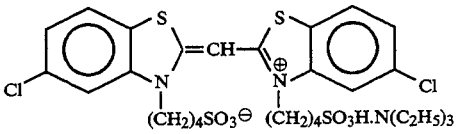 | Sensitizing dye VIII |
| 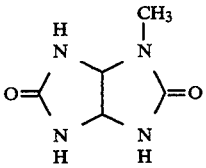 | S-1 |
| $CH_2{=}CH{-}SO_2{-}CH_2{-}CONH{-}CH_2$<br>$CH_2{=}CH{-}SO_2{-}CH_2{-}CONH{-}CH_2$ | H-1 |
TABLE F
| | |
|---|---|
| Compound - (A) | 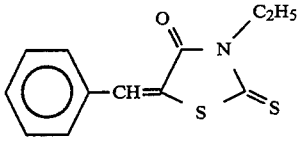 |
TABLE G
C - 7
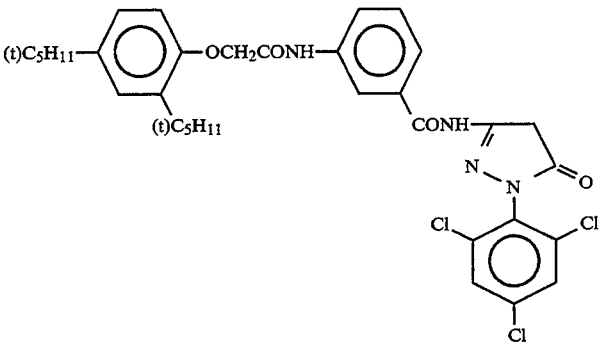

TABLE G-continued
Coupler C - 8
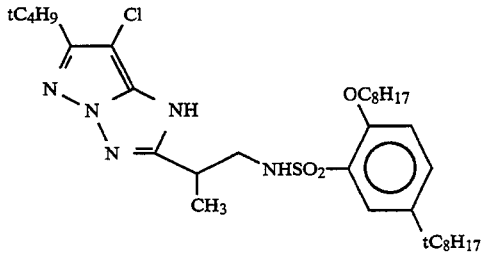
C - 9
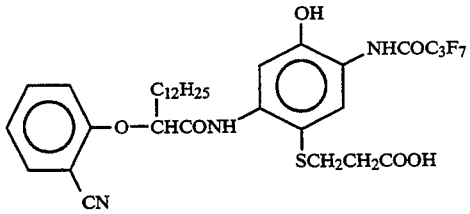
S - 7
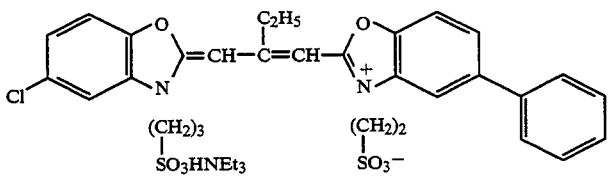
CpdE
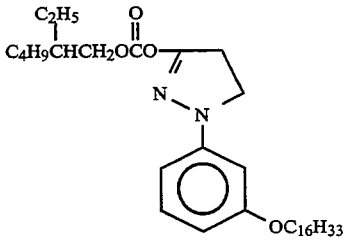
CpdF
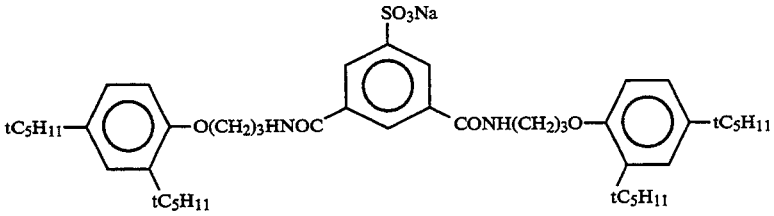
CpdG
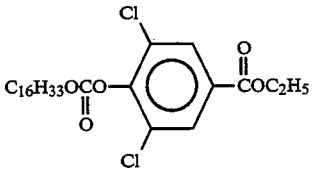
CpdH
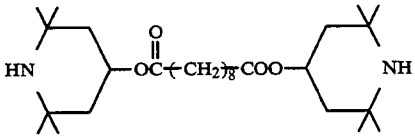

TABLE H
EX-1
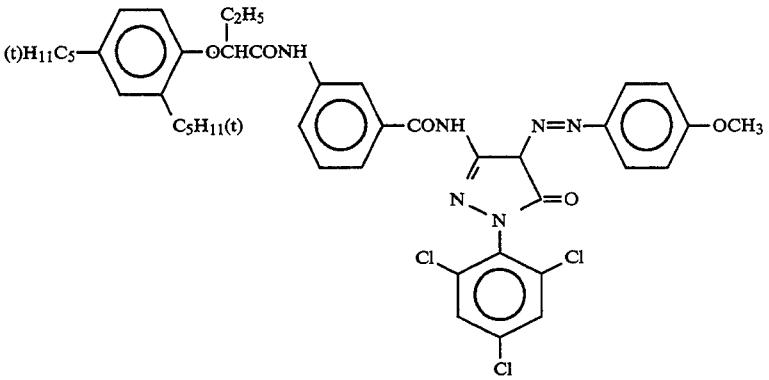
EX-2
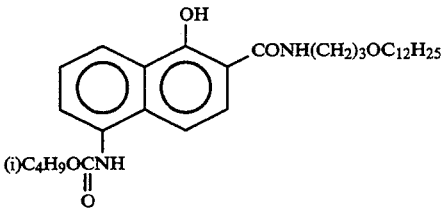
EX-3
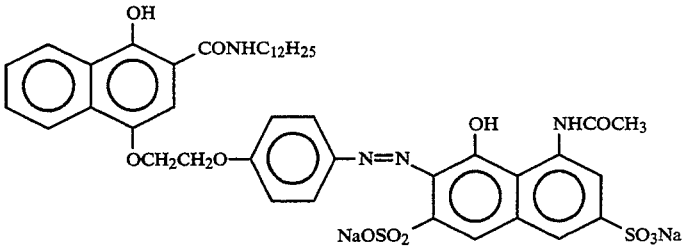
EX-4
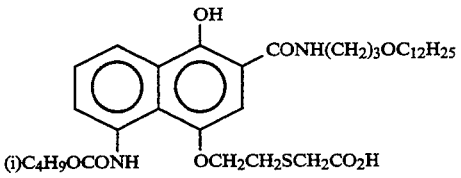
EX-5
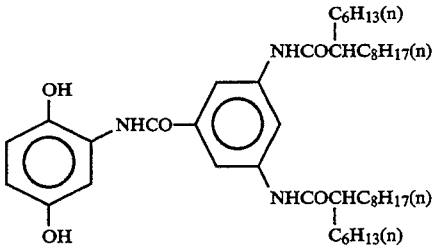

TABLE H-continued
EX-6
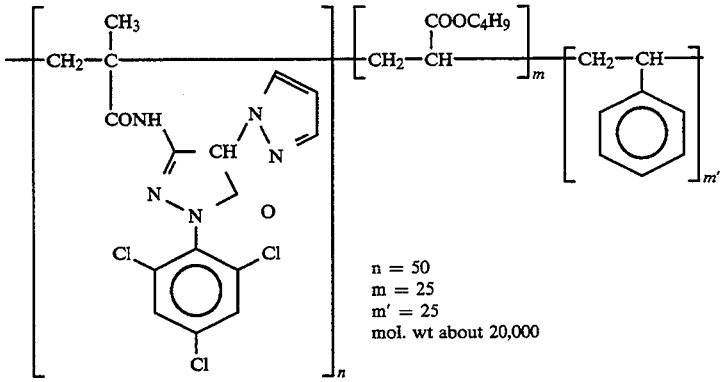
EX-7
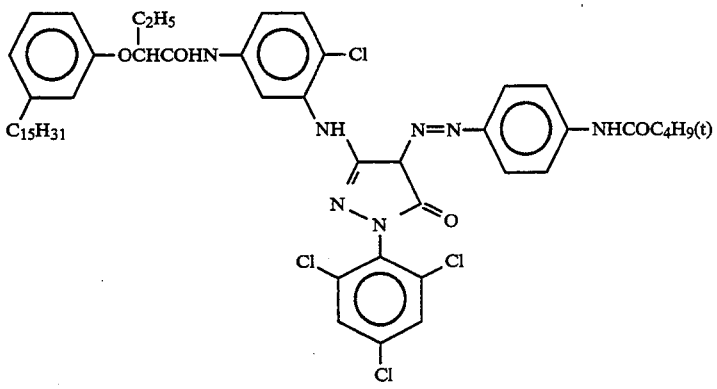
EX-8
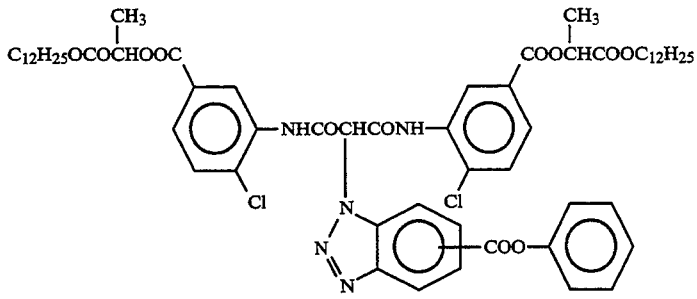
EX-9
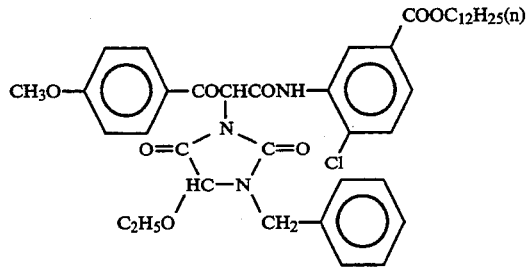

TABLE H-continued
EX-10
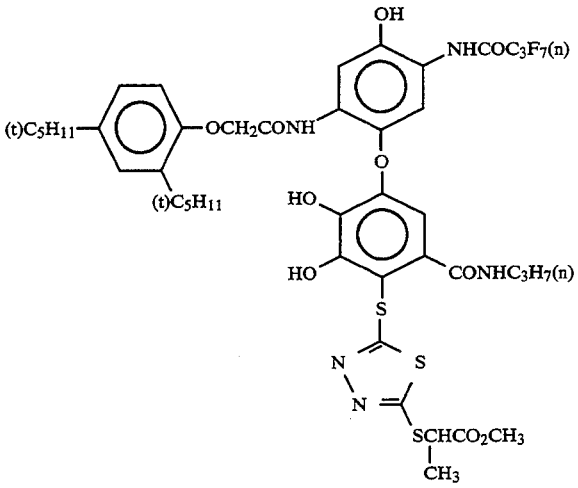
EX-11
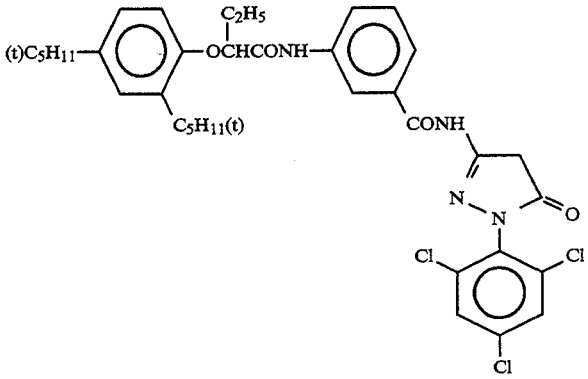
EX-12
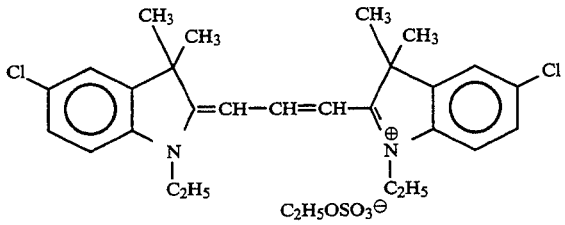
EX-13
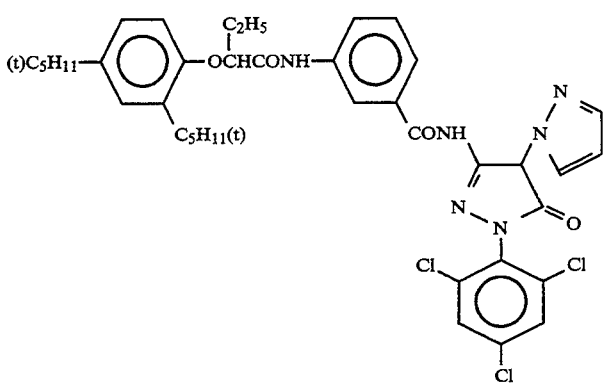
U-1
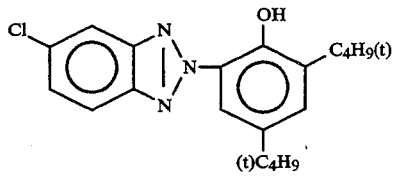

TABLE H-continued
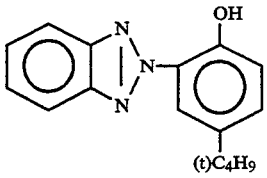
U-2
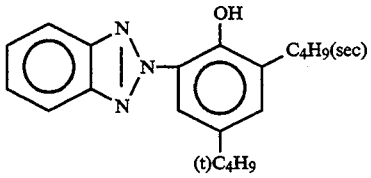
U-3
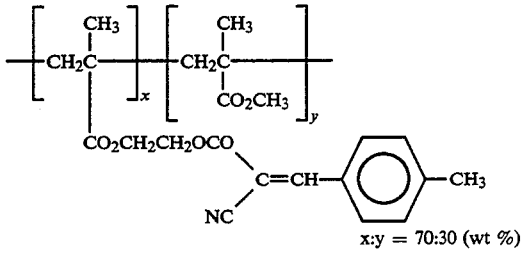
U-4
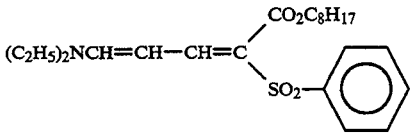
UV-5
tricresyl phosphate HBS-1
di-n-butyl phtalate HBS-2
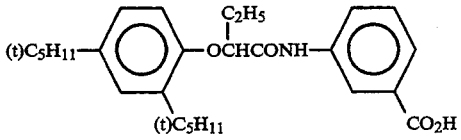
HBS-3
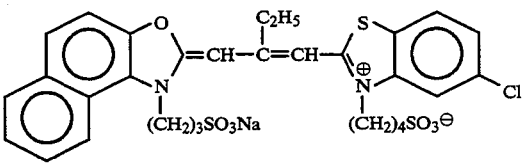
Sensitizing dye I
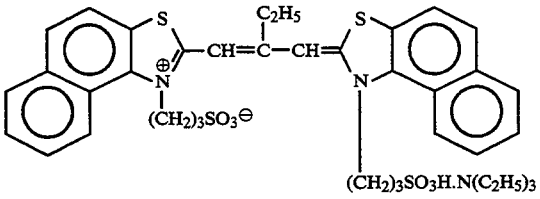
Sensitizing dye II
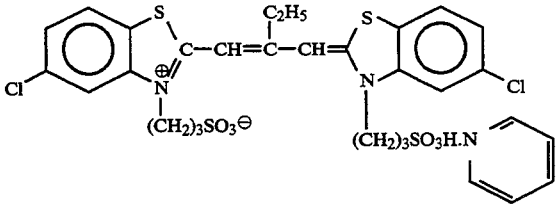
Sensitizing dye III TABLE H-continued

| | |
|---|---|
| 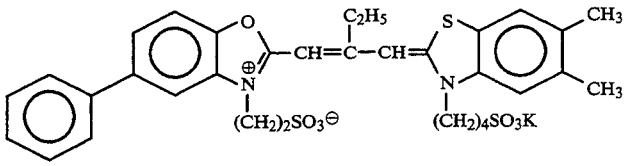 | Sensitizing dye V |
| 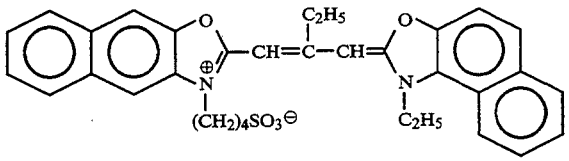 | Sensitizing dye VI |
| 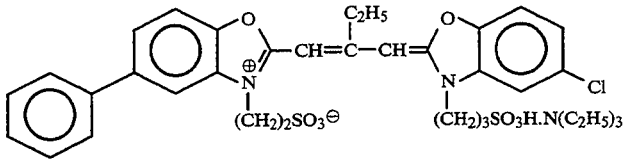 | Sensitizing dye VII |
| 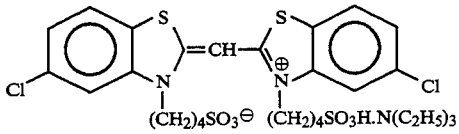 | Sensitizing dye VIII |
| 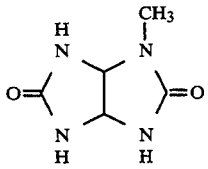 | S-1 |
| $CH_2=CH-SO_2-CH_2-CONH-CH_2$<br>$CH_2=CH-SO_2-CH_2-CONH-CH_2$ | H-1 |

What is claimed is:

1. A silver halide photographic light-sensitive material comprising at least one light-sensitive silver halide emulsion layer on a support, wherein a silver halide emulsion contained in said at least one emulsion layer contains grains having an average grain diameter of not less than 0.3 μm, an average grain thickness of less than 0.5 μm, and an average grain diameter/average grain thickness ratio of not less than 2 in a percentage of at least 50% of a total projected area of emulsion grains, and a compound represented by the following formula (I) is added in an amount of $5\times10^{-5}$ to $5\times10^{-3}$ tool per tool of the silver halide during emulsion grain formation, the addition of said compound of formula (I) is performed after the addition of 85% of the total silver nitrate amount is finished, Formula (I)

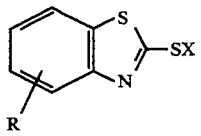

wherein X represents hydrogen or an alkaline metal, and R represents hydrogen, halogen or an alkyl group having 1 to 5 carbons.

2. The silver halide photographic light-sensitive material according to claim 1, wherein said emulsion is chemically sensitized further in the presence of a sensitizing dye in an amount of not less than 0.1 milli mol per mol of said silver halide emulsion.

3. The silver halide photographic light-sensitive material according to claim 2, wherein an addition amount of said sensitizing dye is not less than 0.1 milli mol and less than 4 milli mol per mol of the silver halide.

4. The silver halide photographic light-sensitive material according to claim 3, wherein an addition amount of said sensitizing dye is not less than 0.2 milli mol and less than 1.5 milli mol per mol of the silver halide.

5. The silver halide photographic light-sensitive material according to claim 2, wherein said sensitizing dye is selected from the group consisting of a cyanine dye, a merocyanine dye, a complex cyanine dye, a complex merocyanine dye, a holopolar cyanine dye, a styryl dye, a hemicyanine dye, an oxonol dye and a hemioxonol dye.

6. The silver halide photographic light-sensitive material according to claim 5, wherein said cyanine dye is a compound represented by the following formula (II):

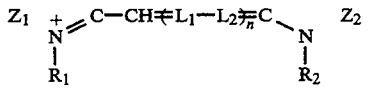

wherein $Z_1$ and $Z_2$ independently represent an atom group required to form a thiazole nucleus, a thiazoline nucleus, a benzthiazole nucleus, a naphthothiazole nucleus, an oxazole nucleus, a benzoxazole nucleus, an oxazoline nucleus, a naphthooxazole nucleus, an imidazole nucleus, a benzoimidazole nucleus, an imidazoline nucleus, a selenazole nucleus, a selenazoline nucleus, a benzoselenazole nucleus or a naphthoselenazole nucleus, $R_1$ and $R_2$ independently represent an alkyl group or a substituted alkyl group, at least one of $R_1$ and $R_2$ having a sulfo group or a carboxy group, each of $L_1$ and $L_2$ independently represents a substituted or nonsubstituted methine group, and n represents an integer from 0 to 2.

7. The silver halide photographic light-sensitive according to claim 1, wherein a ratio of an average grain diameter of grains of said emulsion to an average grain thickness thereof is 3 to 12.

8. The silver halide photographic light-sensitive material according to claim 7, wherein said average grain diameter/average grain thickness ratio is 5 to 10.

9. The silver halide photographic light-sensitive material according to claim 1, wherein an emulsion containing grains having said average grain diameter/average grain thickness of not less than 2 is an emulsion containing monodisperse hexagonal tabular silver halide grains.

10. The silver halide photographic light-sensitive material according to claim 9, wherein said emulsion comprises a dispersion medium and silver halide grains in which not less than 70% of a total projected area of said silver halide grains is occupied by hexagonal tabular silver halide grains having a ratio of a length of an edge having a maximum length to a length of an edge having a minimum length of not less than 2 and two parallel surfaces as outer surfaces, said hexagonal tabular silver grains being monodisperse with a variation coefficient of a grain size distribution of not more than 20% and having an aspect ratio of not less than 2.5 and a grain size of not less than 0.2 μm.

11. The silver halide photographic light-sensitive material according to claim 9, wherein said hexagonal tabular grains comprises silver bromide, silver iodobromide, silver chlorobroimde or silver chloroiodobromide.

12. The silver halide photographic light-sensitive material according to claim 9, wherein the content of iodide ions in said hexagonal tabular grains is 0 to 30 mol %.

13. The silver halide photographic light-sensitive material according to claim 1, wherein said emulsion is chemically sensitized in the presence of a compound of formula (I) during grain formation.

14. The silver halide photographic light-sensitive material according to claim 1, wherein X represents an alkaline metal selected from the group consisting of lithium, sodium and potassium.

15. A method of chemically sensitizing a silver halide emulsion, which comprises adding a compound represented by formula (I) to a silver halide emulsion during grain formation, said emulsion contains grains having an average grain diameter of not less than 0.3 μm, an average grain thickness of less than 0.5 μm and an average grain diameter/average grain thickness ratio of not less than 2 in a percentage of at least 50% of a total projected area of emulsion grains, wherein said compound represented by formula (I) has the following formula:

Formula (I)

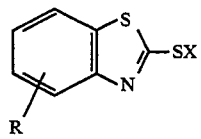

wherein X represents hydrogen or an alkaline metal, and R represents hydrogen, halogen or an alkyl group having 1 to 5 carbons, said compound represented by formula (I) is added in an amount of $5\times10^{-5}$ to $5\times10^{-3}$ mol per mol of the silver halide in said emulsion during emulsion grain formation, the addition of said compound of formula (I) is performed after the addition of 85% of the total silver nitrate amount is finished during grain formation.

16. A silver halide photographic light-sensitive material comprising at least one light-sensitive silver halide emulsion layer on a support, wherein a silver halide emulsion contained in said at least one emulsion layer contains grains having an average grain diameter of not less than 0.3 μm, an average grain thickness of less than 0.5 μm, and an average grain diameter/average grain thickness ratio of not less than 2 in a percentage of at least 50% of a total projected area of emulsion grains, and said emulsion is chemically sensitized in the presence of a compound represented by the following formula (I):

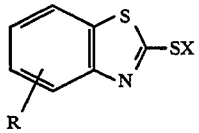

wherein X represents hydrogen or an alkaline metal, and R represents hydrogen, halogen or an alkyl group having 1 to 5 carbons, said compound represented by formula (I) is added in an amount of $1\times10^{-5}$ to $1\times10^{-3}$ mol per mol of the silver halide in said emulsion after said emulsion is desalted.

* * * * *